US010603931B2

(12) United States Patent
De Roeck et al.

(10) Patent No.: US 10,603,931 B2
(45) Date of Patent: Mar. 31, 2020

(54) INKJET PRINTING DEVICE WITH DIMPLED VACUUM BELT

(71) Applicant: AGFA NV, Mortsel (BE)

(72) Inventors: Luc De Roeck, Mortsel (BE); Peter Baeyens, Mortsel (BE); Jeroen Strijckers, Mortsel (BE)

(73) Assignee: AGFA NV, Mortsel (BE)

( * ) Notice: Subject to any disclaimer, the term of this patent is extended or adjusted under 35 U.S.C. 154(b) by 0 days.

(21) Appl. No.: 15/755,264

(22) PCT Filed: Aug. 26, 2016

(86) PCT No.: PCT/EP2016/070160

§ 371 (c)(1),
(2) Date: Feb. 26, 2018

(87) PCT Pub. No.: WO2017/036943

PCT Pub. Date: Mar. 9, 2017

(65) Prior Publication Data

US 2018/0264851 A1 Sep. 20, 2018

(30) Foreign Application Priority Data

Sep. 2, 2015 (EP) ..... 15183429

(51) Int. Cl.
*B41J 11/00* (2006.01)
*B41J 3/407* (2006.01)
(Continued)

(52) U.S. Cl.
CPC ..... *B41J 11/0085* (2013.01); *B41J 3/4078* (2013.01); *B41J 11/001* (2013.01); *B41J 11/007* (2013.01); *B41J 13/0072* (2013.01); *B65H 5/224* (2013.01); *B41J 3/407* (2013.01); *B65H 2406/3223* (2013.01)

(58) Field of Classification Search
CPC .. B41J 11/007; B41J 11/0085; B41J 2/16585; B41J 3/4073; B65G 21/2036; G03G 15/657
See application file for complete search history.

(56) References Cited

U.S. PATENT DOCUMENTS 5,553,536 A * 9/1996 Van Os ..... B41F 15/0827 101/115
5,655,453 A * 8/1997 Ackley ..... A61J 3/007 101/35

(Continued)

OTHER PUBLICATIONS

Official Communication issued in International Patent Application No. PCT/EP2016/070160, dated Jan. 5, 2017.

*Primary Examiner* — John Zimmermann
(74) *Attorney, Agent, or Firm* — Keating and Bennett, LLP

(57) ABSTRACT

An inkjet printing method with an inkjet printing device includes a vacuum belt having a set of air-channels connecting a top-surface and a bottom-surface of the vacuum belt. The set of air-channels couples an inkjet receiver to the vacuum belt by air suction in the set of air-channels, wherein the vacuum belt includes a dimple at the top-surface. The dimple has a closed bottom end, and the dimple is connected with an air-channel of the set of air-channels to form an air cup and to couple the inkjet receiver to the vacuum belt at the dimple by air suction.

13 Claims, 8 Drawing Sheets

(51) Int. Cl.
*B65H 5/22* (2006.01)
*B41J 13/00* (2006.01)

(56) References Cited

U.S. PATENT DOCUMENTS

| | | | | |
|---|---|---|---|---|
| 5,992,994 | A * | 11/1999 | Rasmussen | B41J 2/01 347/104 |
| 6,328,439 | B1 * | 12/2001 | Rhodes | B41J 11/007 347/102 |
| 6,350,009 | B1 * | 2/2002 | Freund | B41J 11/0025 347/101 |
| 7,845,790 | B2 * | 12/2010 | Baker | B41J 11/0065 347/101 |
| 8,292,420 | B2 | 10/2012 | Weingartner et al. | |
| 8,863,939 | B2 * | 10/2014 | Panides | G03G 15/657 198/471.1 |
| 2010/0091056 | A1 * | 4/2010 | Miyagi | B41J 2/16526 347/9 |
| 2012/0141636 | A1 | 6/2012 | Ackley, Jr. et al. | |
| 2014/0285602 | A1 * | 9/2014 | Sasaki | B41J 11/007 347/102 |

* cited by examiner

INKJET PRINTING DEVICE WITH DIMPLED VACUUM BELT

CROSS REFERENCE TO RELATED APPLICATIONS

This application is a 371 National Stage Application of PCT/EP2016/070160, filed Aug. 26, 2016. This application claims the benefit of European Application No. 15183429.8, filed Sep. 2, 2015, which is incorporated by reference herein in its entirety.

BACKGROUND OF THE INVENTION

1. Field of the Invention

The present invention relates to an inkjet printing device which comprises a vacuum belt to hold down an inkjet receiver while printing, especially in an industrial environment.

2. Description of the Related Art

Inkjet printing devices with a vacuum belt to transport an inkjet receiver underneath a printhead are well-known. Such inkjet printing devices currently are adapted for sign & display market with small sized inkjet receivers to for industrial market with much larger inkjet receivers or multiple inkjet receivers, printed at the same time; and special inkjet receivers such as manufacturing methods for glass, laminate floorings, carpets, textiles comprising inkjet printing methods. For example DIEFFENBACHER™ Colorizer is capable for furniture production with formats up to 2070 mm×3600 mm. The special inkjet receivers have sometimes to be handled very carefully on a conveyor belt, such as a vacuum belt, because it is for example brittle; breakable; crumbly or frail.

To print on such large inkjet receivers or multiple inkjet receivers; printed at the same time; large vacuum belts to transport such inkjet receivers are a big challenge. The coupling of these inkjet receivers on the vacuum belt have to remain whole the time until the inkjet receiver is printed. The power, needed for this coupling by air-sucking, has to be very strong which may deform or break the inkjet receiver before, while printing and/or after printing, for example visibility of imprintings from the air sucking holes from the vacuum belt in the inkjet receiver at the back side of the inkjet receiver and sometimes also on the front side, which is the print side; of the inkjet receiver.

But even with a very strong vacuum power for coupling by air-sucking some specific inkjet receivers, such as corrugated fibreboard, textile, leather; plastic foil, thermosetting resin impregnated paper substrate may decoupled by curling, crumpling and/or crinkling of the inkjet receiver while printing and/or curing the inkjet ink on the inkjet receiver. This is in the current inkjet printing devices solved by adding guiders or extra hold-downing means to prevent the decoupling of the inkjet receiver while printing such as disclosed in U.S. Pat. No. 8,292,420 (DURST)

Another issue with the current vacuum belts in such inkjet printing devices is the duration of remaining vacuum pressure if the power of air-sucking is shut-off, especially on such large vacuum belts. This makes the handling of inkjet receivers, especially stiff substrates such as corrugated fiber boards, on and/or off the vacuum belt not easy which enlarges the production timings. Especially for inkjet printing devices in an industrial printing and/or manufacturing environment the minimizing of the duration of remaining vacuum power on shut-off the power, also called de-vacuum-time, of air sucking is of high importance.

Therefore, there remains a need for an inkjet printing device which can handle specific inkjet receivers and/or large-sized inkjet receivers while exhibiting high reliability for industrial inkjet printing.

SUMMARY OF THE INVENTION

In order to overcome the problems described above, preferred embodiments of the present invention have been realised with an inkjet printing device as defined below and an inkjet printing method as also defined below.

Especially a vacuum belt for an inkjet printing device is developed for a better connection of an inkjet receiver against the vacuum belt to avoid collisions, by e.g. curling of the inkjet receiver, to a printhead from the inkjet printing device. Also the present invention is a solution for a faster de-vacuum-time to handle inkjet receivers on and/or off the vacuum belt. It is also found that in the present invention the needed power for creating vacuum on top of the vacuum belt to couple the inkjet receiver is less than the current vacuum belts and that the imprintings of vacuum-belt-air-channels in the inkjet receiver after printing is less visible or even not existing as in the current inkjet printing devices. These benefits are mainly caused by the set of dimples, forming air-cups on the top-surface of the vacuum belt. The disturbing air-flow in these dimples while air-sucking the inkjet receiver against the vacuum belt is probably the main reason for these advantages, such as the shorter duration of remaining vacuum pressure after shut-off the power of air sucking.

Further advantages and embodiments of the present invention will become apparent from the following description.

DETAILED DESCRIPTION OF THE PREFERRED EMBODIMENTS

Figure 1:
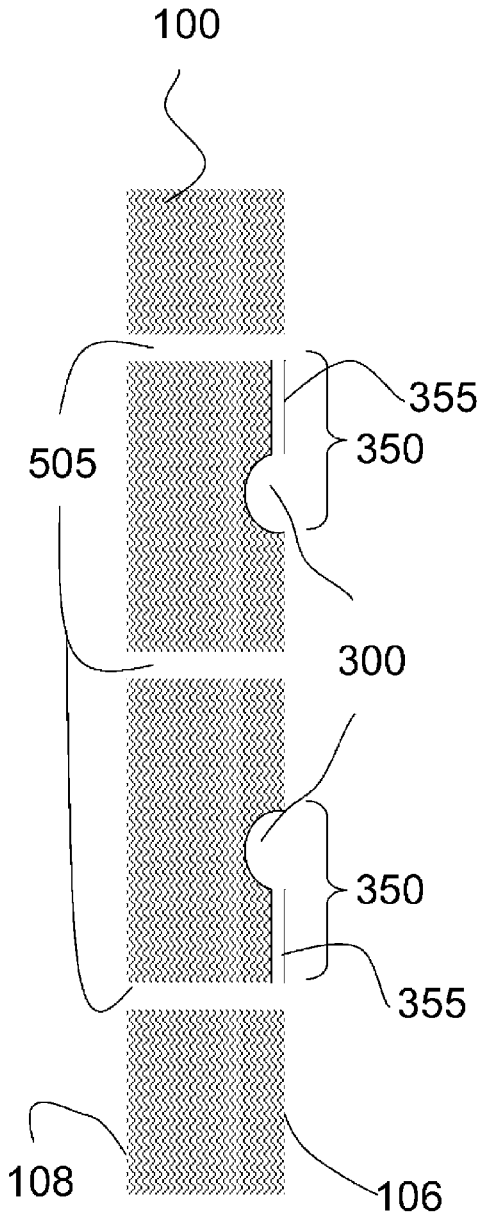
FIG. 1 illustrates an intersection or cross-section of a vacuum belt (100) according a preferred embodiment of the present invention. The vacuum belt (100) comprises dimples (300) which are connected with an air-channel of a set of air-channels (505) to form with the air-cup connector (355) an air-cup (350). The air-cup connector (355) is constructed at the top-surface (106) of the vacuum belt (100). The bottom-surface (108) of the vacuum belt (100) is connected to a vacuum table, which is not visible in this figure.
Figure 2:
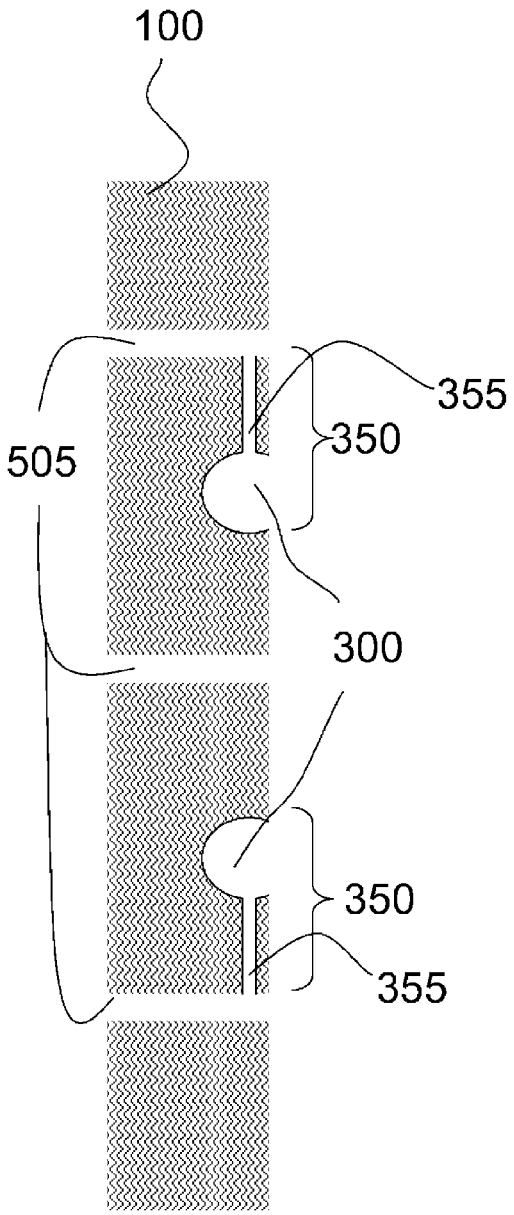
FIG. 2 illustrates an intersection of a vacuum belt (100) according a preferred embodiment of the present invention. The vacuum belt (100) comprises dimples (300) which are connected with an air-channel of a set of air-channels (505) to form with the air-cup connector (355) an air-cup (350). The air-cup connector (355) is constructed between the bottom-surface and the top-surface (106) of the vacuum belt (100).
Figure 3:
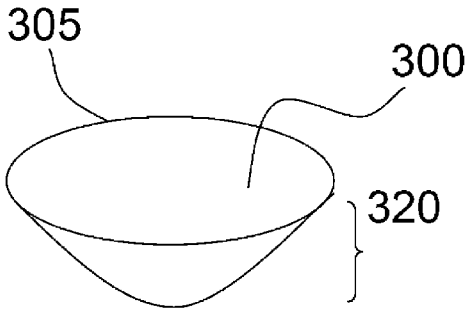
FIG. 3 illustrates a dimple according a preferred embodiment of the present invention. The dimple perimeter (305) is the perimeter formed at the top-surface of the vacuum belt with the dimple and the dimple indentation (320) defines the deepness and shape of the dimple (300).
Figure 4:
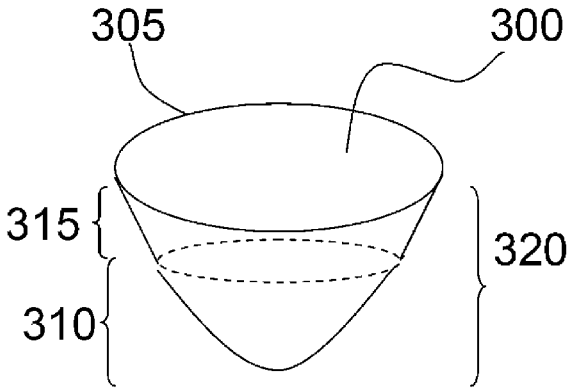
FIG. 4 illustrates a dimple according a preferred embodiment of the present invention. The dimple perimeter (305) is the perimeter formed at the top-surface of the vacuum belt with the dimple and the dimple indentation (320) defines the deepness and shape of the dimple (300). The dimple indentation comprises a portion (310) and a transition surface (315) between the portion (310) and the dimple perimeter (305).
Figure 5:
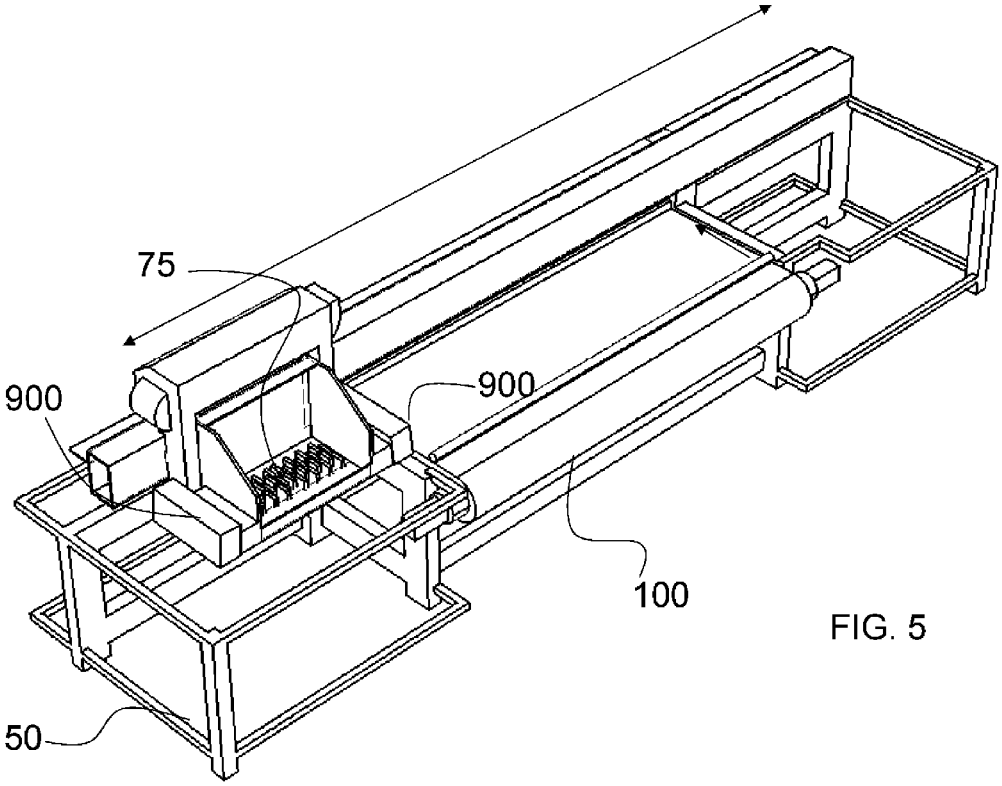
FIG. 5 illustrates an inkjet printing device (50) with two drying systems (900) left and right from a set of printheads with minimum one printhead (75). The inkjet printing device (50) comprises a vacuum belt (100) to transport an inkjet receiver underneath the printhead (75) which moves on a gantry over the inkjet receiver.
Figure 6:
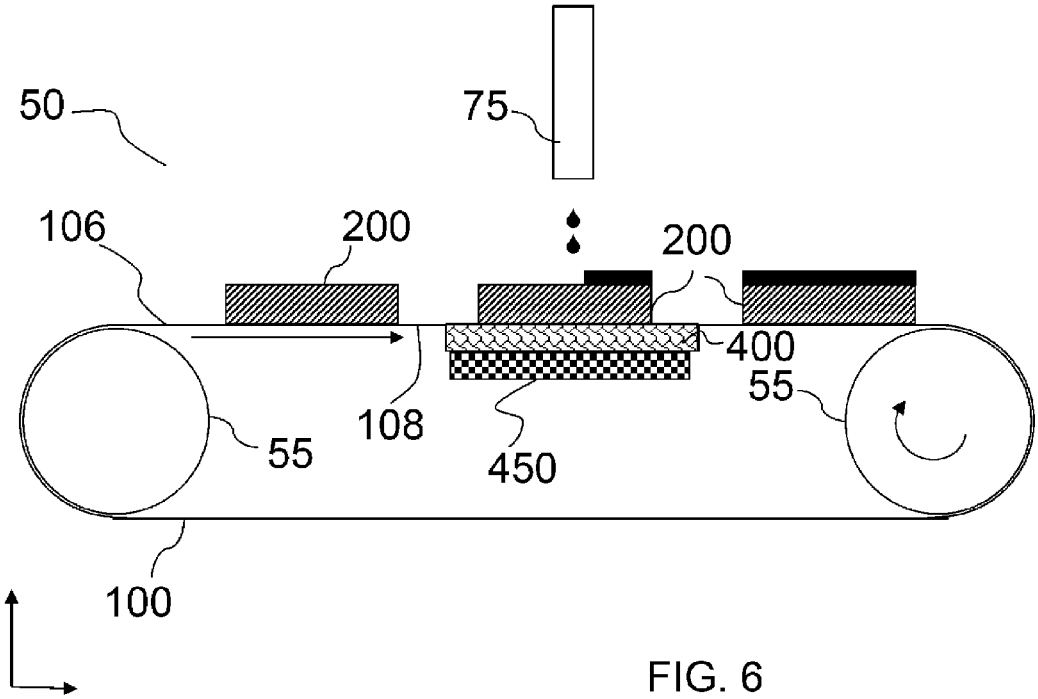
FIG. 6 illustrates an intersection of an inkjet printing device (50) wherein the vacuum belt (100) is wrapped around two pulleys (55) and a vacuum table (400) where under a vacuum chamber (450) is attached. The inkjet receivers (200) are transported underneath a printhead (75) which jets a liquid on the inkjet receivers (200).
Figure 7:
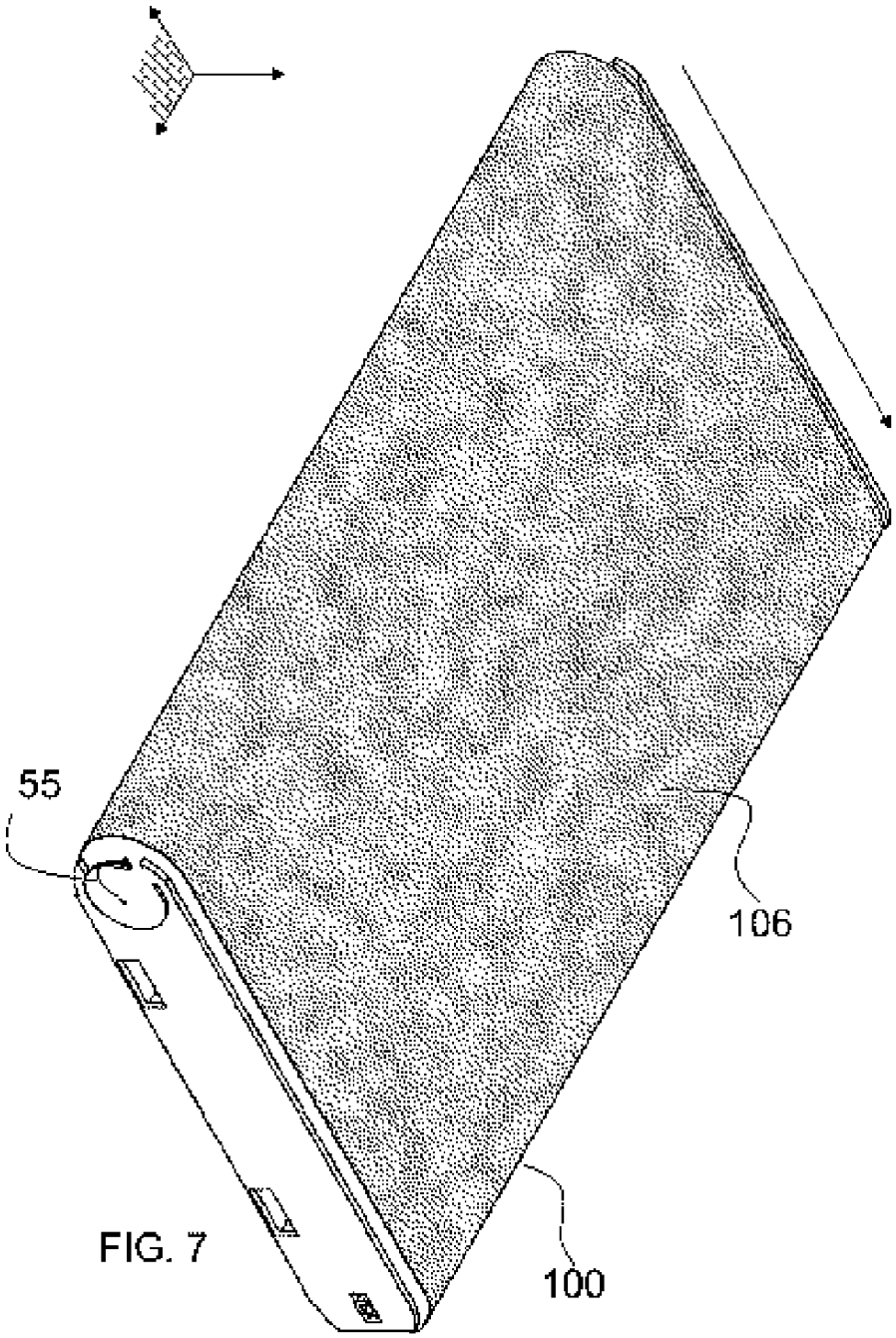
FIG. 7 illustrates a closer view of a vacuum belt (100), wrapped around two pulleys (55)—one can not be seen—and a vacuum table which also can not be seen. The top-surface (106) of the vacuum belt (100) shall transport an ink-receiver.
Figure 8:
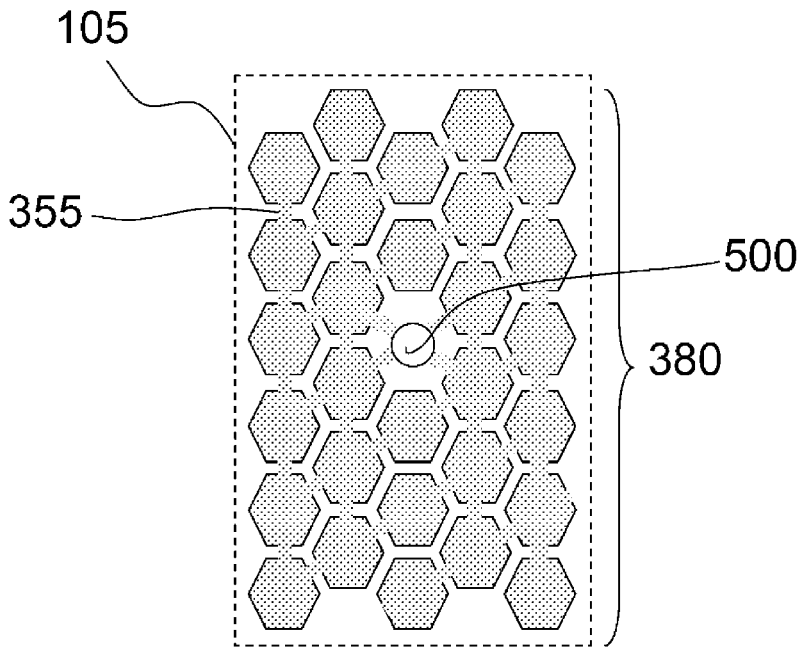
FIG. 8 illustrates an air-sucking zone, in top-view, at a vacuum belt (100)—not visible—according a preferred embodiment of the present invention. The dimples with hexagonal dimple perimeter are forming a dimple pattern (380) with dimple rows and dimple columns. The dimples are connected with a vacuum-belt-air-channel (500) via air-cup connectors (355).
Figure 9:
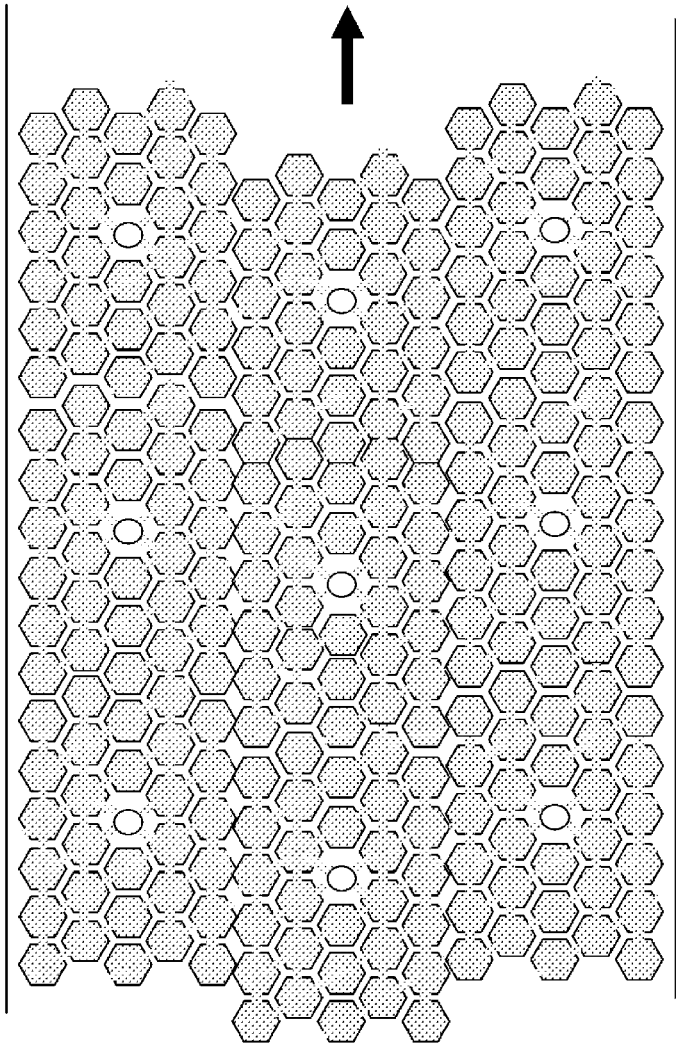
FIG. 9 illustrates a part of a large air-sucking zone, in top-view, at a vacuum belt (100)—partially visible—according a preferred embodiment of the present invention. The arrow illustrates the conveying direction of the vacuum belt (100).
Figure 10:
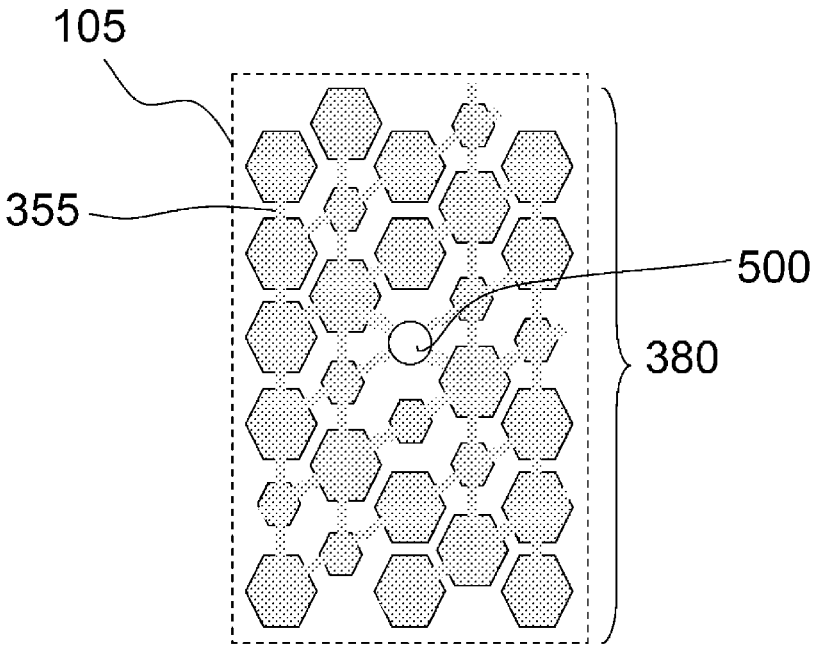
FIG. 10 illustrates an air-sucking zone, in top-view, at a vacuum belt (100)—not visible—according a preferred embodiment of the present invention. The dimples with hexagonal dimple perimeter are forming a dimple pattern (380) with dimple rows and dimple columns. The dimples are connected with a vacuum-belt-air-channel (500) via air-cup connectors (355). The dimple pattern (380) comprises two dimple shapes.

A preferred embodiment of the present invention comprises an inkjet printing device (50) comprising a vacuum belt (100) wherein:

the vacuum belt (100) comprises a set of air-channels (505) connecting top-surface (106) and bottom-surface (108) from the vacuum belt (100); and the set of air-channels (505) couples an inkjet receiver (200) to the vacuum belt (100) by air suction in the set of air-channels (505); and wherein the vacuum belt (100) is characterized by:

comprising a dimple (300) at the top-surface; and wherein the dimple (300) has a closed bottom end; and wherein the dimple (300) is connected with an air-channel of the set of air-channels (505) to form an air cup (350) and to couple the inkjet receiver (200) to the vacuum belt (100) at the dimple (300) by air suction.

Or with other words: an inkjet printing device (50) comprising a conveyor belt wrapped around a printing table wherein:

the conveyor belt comprises a first set of air-channels connecting top-surface and bottom-surface from the conveyor belt; and the first set of air-channels are connected to a second set of air-channels from the printing table to couple a inkjet receiver (200) to the conveyor belt by air suction in the first and second set of air-channels; and wherein the conveyor belt is characterized by:

comprising a dimple at the top-surface; and wherein the dimple has a closed bottom end; and wherein the dimple is connected with an air-channel of the first set of air-channels to form an air cup and to couple the inkjet receiver (200) to the conveyor belt at the dimple by air suction.

Another preferred embodiment of the present invention is an inkjet printing method performed by this inkjet printing device: A printing method on a inkjet receiver (200) by an inkjet printing device comprising a vacuum belt (100) of coupling the inkjet receiver (200) to the vacuum belt (100) by air suction in a set air-channels comprised in the vacuum belt (100) connecting top-surface and bottom-surface from the vacuum belt (100); and wherein the step of coupling the inkjet receiver (200) to the vacuum belt (100) is characterized by air suction in a dimple (300), comprised at the top-surface wherein the dimple (300) has a closed bottom end; and the dimple (300) is connected with an air-channel of the set of air-channels (505) to form an air cup.

The inkjet printing method and inkjet printing device is a solution for an optimal coupling of inkjet receivers (200) to a vacuum belt (100) without deforming or breaking the inkjet receiver, prior, while and/or after printing the inkjet receiver. This is beneficial for a good print quality and an advantage of preventing crashes of inkjet receivers against a printhead (75) of the inkjet printing device due the deformation such as curling. Probably this beneficial is caused by the air-flow in the dimple, as air-cup, which is disturbed versus the laminar flow in the set of very small air-channels from the vacuum belt. The extra coupling at the air-cup makes the need of high powered air-sucking less needed which is an economical advantage especially in industrial manufacturing and/or printing. Less power gives less imprinting of the set of air-channels in the inkjet receiver (200). Also at the dimple (300) it is found that this is even not happening probably to the disturbing air flow in the air-cup between ink-receiver (200) and dimple (300).

In a preferred embodiment the shape of the dimple (=dimple shape) is characterised by:

the area of a dimple perimeter (305) is preferably between 1 and 15 $mm^2$, more preferably between 2 and 8 $mm^2$, most preferably between 3 and 6 $mm^2$; and/or the volume of a dimple is preferably between 1 and 30 $mm^3$, more preferably between 1.8 and 14.2 $mm^3$, most preferably between 2.7 and 8 $mm^3$; and/or the dimple perimeter (305) at the top-surface (106) of the conveyor-belt may be a circle, ellipse, oval, triangle, square, rectangle, pentagon, hexagon, heptagon, octagon, rhombus, rectangle, regular polygon or any polygon containing at least three sides; and/or a portion (310) from the dimple indentation (320) is preferably a spherical; polyhedron; substantially spherical or substantially polyhedron depression wherein the portion (310) or the dimple indentation (320) in it's entirely is preferably a concave indentation; and/or a portion (310) from the dimple indentation (320) is preferably defined by a curved enclosure which is more preferably contained within the dimple perimeter (300) at the top-surface (106); and/or a portion (310) from the dimple indentation (320) is preferably defined by a curved enclosure wherein the curved enclosure contacts all the sides of the dimple perimeter at the top-surface (106) or may contact one or more sides of the dimple perimeter at the top-surface (106) if the dimple perimeter is a polygon or a dimple perimeter which comprises a linear edge; and/or a portion (310) from the dimple indentation (320) is preferably defined by a curved enclosure which is circular, oval or substantially circular; and/or the deepness of the dimple is preferably between 10% and 90%, more preferably between 15% and 70% and most preferably 10% and 60% of the total thickness of the vacuum belt (100); and/or the area of the dimple perimeter is larger than the area of the connected air-channel at the top-surface.

It is found that the dimple shape is quite important to optimize the present invention to bigger advantages. The disturbing air flow may be controlled and optimized by adapting the dimple shape.

In a preferred embodiment the vacuum belts comprises more than one dimples forming an air-cup so the air cup is preferably part from a set of air cups:

to form an air-sucking zone (105) with the set of air-channels (505); and to form a dimple pattern (380) wherein the dimple pattern is a lattice pattern and more preferably the dimple pattern comprises dimple columns or dimple rows; and angle between side edge of the vacuum belt (100) and the dimple columns or dimple rows is between 10 and 80 degrees. This angle between side edge of the vacuum belt (100) and the dimple columns or dimple rows is preferably between 20 and 70 degrees and more preferably between 30 and 60. Most inkjet receivers (200) are rectangular so an angle between 10 an 80 degrees is preferred for easier coupling the edges of rectangular shaped inkjet receivers wherein one of the edges is parallel to the edge of the vacuum belt (100) while transporting and/or printing the inkjet receiver (200).

In another preferred embodiment the air cup is part from a set of air cups:

to form an air-sucking zone (105) with the set of air-channels to form a dimple pattern (380) wherein the dimple pattern is a randomly arranged pattern or a pseudo-randomly arranged pattern.

The dimple pattern may be characterized by:

the distribution of air-cups in the dimple pattern (380) is more than 2 air-cups per $dm^2$ and/or;

the distribution of vacuum-belt-air-channels (500) in the air-sucking zone (105) is between 1 vacuum-belt-air-channel per dm2 and 10 vacuum-belt-air-channels (500) per $dm^2$ and/or if the dimple pattern is a lattice pattern with dimple rows and dimple columns, the density of air-cups (350) in a dimple row and/or dimple column is more than 2 air-cups per dm; and/or the ratio between the total area from the dimple perimeters on the top-surface (106) of the set of air-cups and the area of the air-sucking zone is between 10% and 90%; and/or the ratio between the total area from the dimple perimeters on the top-surface (106) of the set of air-cups and the total area of the perimeters of the first set of air-channels (505) on the top-surface (106) is preferably between 0.4% and 300%; and/or the ratio between the area of each air-channel of the set of air-channels (505) at the top-surface (106) from the vacuum belt (100) and the area of the dimple perimeter on the top-surface (106) of each air-cup (350) of the set of air-cups is between 5% and 90%.

In a preferred embodiment the air-channel of the set of air-channels is connected to more than one dimple from the set of air cups.

The set of air-ups in the vacuum belt may comprise more than one dimple shape.

The surface roughness (Ra) of the top-surface (106) from the vacuum belt (100), more preferably of the top-surface at the dimple pattern (380), is between 8 and 350 μm; and more preferably between 10 and 250 μm; and most preferably between 11 and 150 μm.

The inkjet receiver is preferably textile, leather, corrugated fibre board, plastic foil or thermosetting resin impregnated paper substrate.

Dimple (300)

A dimple is a well-known term for structures on a golf-ball. It could be defined as an indentation made in a smooth surface. An embodiment of the present invention is an inkjet printing device (50) comprising a conveyor-belt wherein the conveyor-belt is wrapped around a printing table; and wherein by air suction the inkjet receiver (200) is hold down against the conveyor-belt and printing table through holes in the conveyor-belt and the printing table which is connected with a vacuum chamber (450). Such printing table is also called a vacuum table. The conveyor-belt is in such inkjet printing device also wrapped around a plurality of pulleys (55), preferably two pulleys (55). In a preferred embodiment of the present invention the conveyor belt (100), at its top-surface (106), comprises a set of dimples.

The conveyor-belt comprises therefore a first set of air-channels (505), which are connecting top-surface (106) and bottom-surface (108) of the conveyor-belt; and wherein the first set of air-channels (505) are connected to a second set of air-channels (605) in the printing table. The printing table comprises, mostly underneath it, a vacuum chamber (450) which generates a vacuum pressure, by air suction, in the first set of air-channels (605) and, by connection, also a vacuum pressure in the first set of air-channels (505). An air-channel of the first set of air-channels (505) is also called a vacuum-belt-air-channel (500) and an air-channel of the second set of air-channels (605) is also called a printing-table-air-channel. The conveyor-belt with the first set of air-channels (505) is also called a porous conveyor-belt and vacuum belt (100). The printing table with the second set of air-channels is also called a porous printing table or vacuum table (400).

The dimple perimeter (305) at the top-surface (106) of the conveyor-belt may be a circle, ellipse, oval, triangle, square, rectangle, pentagon, hexagon, heptagon, octagon, rhombus, rectangle, regular polygon or any polygon containing at least three sides. It may have at least one curved edge or non-linear edge. In accordance to another aspect of the invention, one or more sides of a polygonal dimple perimeter may be non-linear or curved. The advantage of a polygonal dimple perimeter is that more dimples with such dimple perimeter can be constructed on the top-surface of the vacuum belt (100) of the present invention.

A portion (310) from the dimple indentation (320) is preferably a spherical; polyhedron; substantially spherical or substantially polyhedron depression wherein the portion (310) or the dimple indentation (320) in it's entirely is preferably a concave indentation. The portion (310) is preferably defined by a curved enclosure which is more preferably contained within the dimple perimeter (300) at the top-surface (106). The portion is preferably defined by a curved enclosure wherein the curved enclosure contacts all the sides of the dimple perimeter at the top-surface (106) or may contact one or more sides of the dimple perimeter at the top-surface (106) if the dimple perimeter is a polygon or a dimple perimeter which comprises a linear edge. The portion (310) is preferably defined by a curved enclosure which is circular, oval or substantially circular.

Preferably a transitional surface (315) connects the portion (310) to the dimple perimeter. The transitional surface may be a flat surface, substantially flat surface or a curved surface, such as conical, cylindrical, spherical, parabolic or other shapes. The transition surface (315) preferably blends the curvature of the portion (310) to the border of the polygonal dimple perimeter.

The dimple perimeter (305) at the top-surface (106) and the dimple indentation (320) may be radially symmetric, i.e., the centre of the dimple perimeter and the centre of the portion (310) and/or dimple indentation are proximate to each other. These two centres may also coincide to each other. Alternatively, the dimple perimeter (305) and the dimple indentation (320) may be radially asymmetric, i.e., the centre of the dimple perimeter (305) and the centre of the portion (310) and/or dimple indentation (320) are offset from each other.

The area of a dimple perimeter (305) is preferably between 1 and 15 $mm^2$, more preferably between 2 and 8 $mm^2$, most preferably between 3 and 6 $mm^2$.

The volume of a dimple is preferably between 1 and 30 $mm^3$, more preferably between 1.8 and 14.2 $mm^3$, most preferably between 2.7 and 8 $mm^3$.

The dimple indentation (320) or a portion of the dimple indentation (310) is preferably constructed to minimize the de-vacuum-timing, to optimize the hold down of the substrate before; while and after printing and/or to minimize the imprinting/deforming.

The dimple indentation (320) or a portion of the dimple indentation (310) may be coated to have easy cleaning performances of the dimple which may be caused e.g. by dust or ink leaks. The coating in the dimple indentation (310) is preferably a dust repellent and/or ink repellent and/or hydrophobic coating.

The dimple indentation (320) or a portion of the dimple indentation (310) may be treated with an ink repelling hydrophobic method by creating a lubricious and repelling surface which reduces friction.

A dimple may comprise in its dimple indentation (320) another dimple. This dimple shape is called a dimple-in-a-dimple shape.

The deepness of the dimple is preferably between 10% and 90%, more preferably between 15% and 70% and most preferably 10% and 60% of the total thickness of the vacuum belt (100); and/or the area of the dimple at the top-surface is larger than the area of the connected air-channel at the top-surface.

Air-Cup (350)

An air-cup (350) is a dimple (300) at the top-surface (106) of the vacuum belt (100) which is connected to a vacuum-belt-air-channel (500). Air suction in this air-channel shall give rise to air suction in the dimple via this connection, also called air-cup connector (355). The air-cup (350) has preferably a closed bottom end and more preferably the air-cup (350) is sideward's connected to the air-channel (500). The lateral connection may be an air-gutter (357) at the top-surface (106) or may be another air-channel (358) between top and bottom-surface (108) of the vacuum belt (100). An air cup (350) may have a set of air-cup connectors (355) to the same vacuum-belt-air-channel (500) and/or may have a set of air-cup connectors (355) to a set of vacuum-belt-air-channels. An air-cup (350) may be connected to the vacuum-belt-air-channel (500) via a set of air-cups (350) and their air-cup connectors (355).

The dimple indentation (320) or a portion of the dimple indentation (310) from an air cup is preferably constructed to optimized the cleaning performances of the vacuum belt (100); and/or optimal hold-down of inkjet receivers (200) against the vacuum belt (100).

The dimple indentation (320) or a portion of the dimple indentation (310) from an air-cup may be coated to have easy cleaning performances of the dimple which may be caused e.g. by dust or ink leaks and/or may be coated to influence the air flow to perform a better air suction in the air-cup.

Dimple Pattern (380)

In a preferred embodiment the dimple (300) on the top-surface (106) from the vacuum belt (100) of the present invention is part of a set of air-cups to form an air-sucking zone (105) with the first set of air-channels (505) and to form a dimple pattern (380) on the top-surface (106) of the vacuum belt (100). The dimple pattern (380) is preferably formed regular and/or symmetrical to have easy cleaning performances for the top-surface (106) of the vacuum belt (100) and more preferably the dimple pattern (380) is a lattice pattern, which may have dimple rows and dimple columns at the top-surface (106). A lattice pattern in a dimple pattern (380) maybe a pattern with rhombic lattice, rectangular lattice, square lattice, hexagonal lattice, parallelogram lattice, equilateral triangular lattice or a honeycomb lattice of dimples. In another preferred embodiment the dimple pattern (380) is a randomly arranged pattern or pseudo-randomly arranged pattern and in a more preferred embodiment the dimple pattern (380) is a blue noise pseudo-randomly arranged pattern but the lattice pattern is most preferred because it is found that it has an easier cleaning performance than a pseudo-randomly arranged pattern.

In a more preferred embodiment another air-sucking zone (105) is also comprised in the vacuum belt (100) which is formed by another set of air-cups to construct a dimple pattern (380) on the top-surface (106 of the vacuum belt (100).

In a preferred embodiment the distribution of air-cups in the dimple pattern (380) is more than 2 air-cups per $dm^2$, more preferably between 4 air-cups per $dm^2$ and 400 air-cups per $dm^2$, most preferably between 10 air-cups per $dm^2$ and 200 air-cups per $dm^2$.

The distribution of vacuum-belt-air-channels (500) in the air-sucking zone (105) is preferably between 1 vacuum-belt-air-channel per dm2 and 100 vacuum-belt-air-channels (500) per $dm^2$; more preferably between 5 vacuum-belt-air-channels per $dm^2$ and 50 per $dm^2$.

If the dimple pattern is a lattice pattern with dimple rows and dimple columns, the density of air-cups (350) in a dimple row and/or dimple column is preferably more than 2 air-cups per dm, more preferably between 1 air-cup per dm and 20 air-cups per dm, most preferably more than 30 air-cups per dm.

The ratio between the total area from the dimple perimeters on the top-surface (106) of the set of air-cups and the area of the air-sucking zone is preferably between 10% and 90%, more preferably between 20% and 85%, most preferably between 60% and 80%.

The ratio between the total area from the dimple perimeters on the top-surface (106) of the set of air-cups and the total area of the perimeters of the first set of air-channels (505) on the top-surface (106) is preferably between 0.4% and 300%.

The ratio between the area of each air-channel of the set of air-channels (505) at the top-surface (106) from the vacuum belt (100) and the area of the dimple perimeter on the top-surface (106) of each air-cup (350) of the set of air-cups is preferable between 5% and 90%, more preferable between 10% and 70% and most preferably between 20% and 50%.

The manufacturing of a dimple or air-cup is preferably done by calendering, more preferably by hot calendering and most preferably by hot and high pressure calendering of the top-surface of conveyor belt material. Before a conveyor belt is made, whether or not an endless conveyor belt, the conveyor belt material is manufactured roll-to-roll or roll-to-sheet. From a sheet of conveyor belt material the conveyor belt is produced by connecting two ends of the sheet together.

Another way, and more preferably way, of forming a dimple, dimple pattern or air-cup may be done by a laser-engraving method in the top-surface of conveyor belt material or stereolithography method on the top-surface of conveyor belt. The high accuracy and high resolution of both methods due to laser technology is an advantage. An embodiment of the present invention is a method of manufacturing of a dimple or dimple pattern or air-cup by laser-engraving. The power and/or positioning of the laser light defines in this embodiment than the shape of a dimple, air-cup, density of dimples in a dimple area and/or all other features of dimples and air-cups and dimple patterns as disclosed in this present invention. Another embodiment of the present invention is a method of manufacturing of a dimple or dimple pattern or air-cup by stereolithography. The power and/or positioning of the laser light defines in this embodiment than the shape of a dimple, air-cup, density of dimples in a dimple area and/or all other features of dimples and air-cups and dimple patterns as disclosed in this present invention.

The most preferably manufacturing method of a dimple, dimple pattern or air-cup is by a photo-polymerisation method with mask. The mask defines than the dimple, air-cup and/or dimple pattern. For example supplying a layer of light-sensitive polymer on the conveyor belt material and placing a film negative, as mask, over the conveyor belt material, which is exposed to ultra-violet light. The polymer hardens where light passes through the film and than washed the untreated parts of the light-sensitive polymer away preferably in a tank of either water or solvent. Brushes may scrub the conveyor belt material to facilitate the "washout" process. The advantage of such photo-polymerisation method is the high accuracy, high resolution and no dust generation in this manufacturing method. An embodiment of the present invention is a method of manufacturing of a dimple or dimple pattern or air-cup by a photo-polymerisation method with mask. The mask defines in this embodiment than the shape of a dimple, air-cup, density of dimples in a dimple area and/or all other features of dimples and air-cups and dimple patterns as disclosed in this present invention. The light may be absorbed either directly by the reactant monomer (direct photo-polymerization), or else by a photo-sensitizer which absorbs the light and then transfers energy to the monomer. Preferably the photo-polymerisation is an UV photo-polymerisation.

The manufacturing of a dimple, dimple pattern or air-cup may also be done by a moulding process wherein a liquid or pliable layer on the top-surface of the conveyor belt is shaped using a rigid frame called a mould. The liquid or pliable layer may in a later step be hardened to form the dimple, dimple pattern or air-cup for example by an IR source or UV source.

The manufacturing of a dimple; dimple pattern or air cup may also be done by a 3D printing process: successive supplying layers on top of the conveyor belt material.

All the previous manufacturing methods of a dimple, dimple pattern or air cup in a conveyor belt material may comprise the step of polishing the dimple, dimple pattern or air cup to get a flat conveyor belt.

All the previous manufacturing methods of a dimple, dimple pattern or air cup in a conveyor belt material is preferable for a conveyor belt in an inkjet printing device; more preferably for a vacuum belt in an inkjet printing device and most preferable for a vacuum belt in an single-pass inkjet printing device. The result of the manufacturing method is an embodiment of the present invention: a conveyor belt, more preferably a vacuum belt and most preferably a vacuum belt for an inkjet printing device.

The surface roughness may be measured with a Dektak-8™ stylus profiler and contact-based 2D topography measurements. The geometry of the stylus is preferably 2.5 μm at 45 degrees and a stylus force 15 mg with a scan-resolution of 1.1 μm per sample. The processed option of the measurement is preferable X-flattening of Dektak™.

Inkjet Printing Device (50)

An inkjet printing device (50), such as an inkjet printer, is a marking device that is using a printhead (75) or a printhead (75) assembly with one or more printheads (75), which jets a liquid, as droplets or vaporized liquid, on a inkjet receiver (200). A pattern that is marked by jetting of the inkjet printing device (50) on a inkjet receiver (200) is preferably an image. The pattern may be achromatic or chromatic colour.

A preferred embodiment of the inkjet printing device (50) is that the inkjet printing device (50) is an inkjet printer and more preferably a wide-format inkjet printer. Wide-format inkjet printers are generally accepted to be any inkjet printer with a print width over 17 inches. Inkjet printers with a print width over the 100 inches are generally called super-wide printers or grand format printers. Wide-format printers are mostly used to print banners, posters, textiles and general signage and in some cases may be more economical than short-run methods such as screen printing. Wide format printers generally use a roll of inkjet receiver (200) rather than individual sheets of inkjet receiver (200) but today also wide format printers exist with a printing table whereon inkjet receiver (200) is loaded. A wide-format printer preferably comprises a belt step conveyor system.

A printing table in the inkjet printing device (50) may move under a printhead (75) or a gantry may move a printhead (75) over the printing table. These so called flat-table digital printers most often are used for the printing of planar inkjet receivers (200), ridged inkjet receivers (200) and sheets of flexible inkjet receivers (200). They may incorporate IR-dryers or UV-dryers to prevent prints from sticking to each other as they are produced. An example of a wide-format printer and more specific a flat-table digital printer is disclosed in EP1881903 B (AGFA GRAPHICS NV).

The inkjet printing device (50) may perform a single pass printing method. In a single pass printing method the inkjet printheads (75) usually remain stationary and the inkjet receiver (200) is transported once under the one or more inkjet printheads (75). In a single pass printing method the method may be performed by using page wide inkjet printheads (75) or multiple staggered inkjet printheads (75)

which cover the entire width of the inkjet receiver (200). An example of a single pass printing method is disclosed in EP2633998 (AGFA GRAPHICS NV). Such inkjet printing device (50) is also a called a single pass inkjet printing device (50).

The inkjet printing device (50) may mark first a transfer belt that in a second step transfer the marking to an inkjet receiver (200). The inkjet printing device (50) preferably perform a printing method which comprises directing droplets of an inkjet ink onto an intermediate transfer member, such as transfer belt, to form an ink image, the ink including an organic polymeric resin and a coloring agent in an aqueous carrier, and the transfer member having a hydrophobic outer surface so that each ink droplet in the ink image spreads on impinging upon the intermediate transfer member to form an ink film. The inkjet ink is dried while the inkjet ink image is being transported by the intermediate transfer member by evaporating the aqueous carrier from the ink image to leave a residue film of resin and coloring agent. The residue film is then transferred to the inkjet receiver (200). The chemical compositions of the inkjet ink and of the surface of the intermediate transfer member are selected such that attractive intermolecular forces between molecules in the outer skin of each droplet and on the surface of the intermediate transfer member counteract the tendency of the ink film produced by each droplet to bead under the action of the surface tension of the aqueous carrier, without causing each droplet to spread by wetting the surface of the intermediate transfer member.

The inkjet printing device (50) may mark a broad range of inkjet receivers (200) such as folding carton, acrylic plates, honeycomb board, corrugated board, foam, medium density fibreboard, solid board, rigid paper board, fluted core board, plastics, aluminium composite material, foam board, corrugated plastic, carpet, textile, thin aluminium, paper, rubber, adhesives, vinyl, veneer, varnish blankets, wood, flexographic plates, metal based plates, fibreglass, plastic foils, transparency foils, adhesive PVC sheets, impregnated paper and others. An inkjet receiver (200) may comprise an inkjet acceptance layer. An inkjet receiver (200) may be a paper substrate or an impregnated paper substrate or a thermosetting resin impregnated paper substrate.

Preferably the inkjet printing device (50) comprises one or more printheads jetting UV curable ink to mark inkjet receiver (200) and a UV source (=Ultra Violet source), as dryer system (900), to cure the inks after marking. Spreading of a UV curable inkjet ink on an inkjet receiver (200) may be controlled by a partial curing or "pin curing" treatment wherein the ink droplet is "pinned", i.e. immobilized where after no further spreading occurs. For example, WO 2004/002746 (INCA) discloses an inkjet printing method of printing an area of a inkjet receiver (200) in a plurality of passes using curable ink, the method comprising depositing a first pass of ink on the area; partially curing ink deposited in the first pass; depositing a second pass of ink on the area; and fully curing the ink on the area.

A preferred configuration of UV source is a mercury vapour lamp. Within a quartz glass tube containing e.g. charged mercury, energy is added, and the mercury is vaporized and ionized. As a result of the vaporization and ionization, the high-energy free-for-all of mercury atoms, ions, and free electrons results in excited states of many of the mercury atoms and ions. As they settle back down to their ground state, radiation is emitted. By controlling the pressure that exists in the lamp, the wavelength of the radiation that is emitted can be somewhat accurately controlled, the goal being of course to ensure that much of the radiation that is emitted falls in the ultraviolet portion of the spectrum, and at wavelengths that will be effective for UV curable ink curing. Another preferred UV source is an UV-Light Emitting Diode, also called an UV-LED.

The inkjet printing device (50) may comprise an IR source (=Infra Red source) to solidify the ink by infra-red radiation. The IR source is preferably a NIR source (=Near Infra Red source) such as a NIR lamp. The IR source may comprise carbon infrared emitters which has a very short response time.

The IR source or UV source in the above preferred embodiments create a curing zone on the vacuum belt to immobilize jetted ink on the inkjet receiver (200).

The inkjet printing device (50) may comprise corona discharge equipment to treating the inkjet receiver (200) before the inkjet receiver (200) passes a printhead (75) of the inkjet printing device because some inkjet receivers (200) have chemically inert and/or nonporous top-surfaces leading to a low surface energy which may result in bad print quality.

An embodiment of the printing method is preferably performed by an industrial inkjet printing device such as a textile inkjet printing device, corrugated fibreboard inkjet printing device, decoration inkjet printing device.

An embodiment of the printing method is preferably comprised in an industrial inkjet printing method such as a textile inkjet printing method, a corrugated fibreboard inkjet printing method, a decoration inkjet printing method.

3D Inkjet Printer

The inkjet printing device (50) that performs the printing method of the present invention may be used to create a structure through a sequential layering process by jetting sequential layers, also called additive manufacturing or 3D inkjet printing. So the printing method is preferably comprised in a 3D inkjet printing method or stereolithographic method. The objects that may be manufactured additively by an embodiment of the inkjet printing device (50) can be used anywhere throughout the product life cycle, from pre-production (i.e. rapid prototyping) to full-scale production (i.e. rapid manufacturing), in addition to tooling applications and post-production customization. Preferably the object jetted in additive layers by the inkjet printing device (50) is a flexographic printing plate. An example of such a flexographic printing plate manufactured by an inkjet printing device (50) is disclosed in EP2465678 B (AGFA GRAPHICS NV). Especially a hot printing zone and/or hot curing zone in such inkjet printing devices (50) may deform the partially or wholly printed 3D object so the coupling of the partially or wholly printed 3D object against the current vacuum belts is not guaranteed so transport problems can become an issue. The present invention solves this worse coupling of current vacuum belts with the inkjet receiver (200).

Computer-To-Plate System

The inkjet printing device (50) of an embodiment may be used to create printing plates used for computer-to-plate (CTP) systems in which a proprietary liquid is jetted onto a metal base to create an imaged plate from the digital record. So the printing method of an embodiment is preferably comprised in an inkjet computer-to-plate manufacturing method. These plates require no processing or post-baking and can be used immediately after the ink-jet imaging is complete. Another advantage is that platesetters with an inkjet printing device (50) is less expensive than laser or thermal equipment normally used in computer-to-plate (CTP) systems. Preferably the object that may be jetted by an embodiment of the inkjet printing device (50) is a lithographic printing plate. An example of such a lithographic printing plate manufactured by an inkjet printing device (50) is disclosed EP1179422 B (AGFA GRAPHICS NV).

The handling of printing plates on a vacuum belt is difficult due to uncontrolled adhering of this inkjet receiver (200) against the vacuum belt. Heat on the inkjet receiver (200) may cause a curvature effect on the inkjet receiver (200) which can not be hold down on current vacuum belts so the inkjet receiver (200) may crash against a printhead (75) from the inkjet printing device (50). If no extra guiding means are implemented in the inkjet printing device (50) to hold down the printing plate which introduces an extra manufacturing cost. For example in a hot printing area and/or hot curing area, if available, the adhering of such printing plates against the vacuum belt is less. But in the present invention the connection, the hold-down and flat-down, of the inkjet receiver (200) with the vacuum belt is guaranteed even in these hot printing area and/or curing area, if available, from the inkjet printing device (50).

Textile Inkjet Printing Device

Preferably the inkjet printing device (50) is a textile inkjet printing device, performing a textile inkjet printing method. The handling of such inkjet receivers (200) on a vacuum belt is difficult due to uncontrolled adhering of the inkjet receiver (200) against the vacuum belt due to easy crinkle of the inkjet receiver (200) while transporting and/or heat upon the surface of the textile, for example in a hot print zone and/or hot curing zone This crinkle effect on the inkjet receiver (200) can not be hold down and hold flat on current vacuum belts so the inkjet receiver (200) may touch against a printhead (75) from the inkjet printing device (50). Also crinkled textile is not acceptable for sale for example by bad print quality if the textile was not flat while printed. If no extra guiding means are implemented in the inkjet printing device (50) to hold down and flat the textile which introduces an extra manufacturing cost. For example in a hot printing area and/or hot curing area, if available, the crinkle effect of the textile can be become bigger. But in the present invention the connection, the hold-down and flat-down, of the inkjet receiver (200) with the vacuum belt is guaranteed even in these hot printing area and/or curing area, if available, from the inkjet printing device (50). The present invention has also the advantage that no imprinting exists of the dimple pattern in the textile after printing. The textile is preferably pre-treated by corona treatment by corona discharge equipment because some textiles have chemically inert and nonporous surfaces leading to a low surface energy. Also some textiles also have issues with shrinkage which is avoided by the present invention by a good overall coupling of the textile on the vacuum belt. This is a very high advantage for a textile inkjet printing device. Currently sticky conveyor belts are used to avoid this shrinkage issue on textiles but therefore the conveyor belts have to be applied regularly with glue but this is not needed with the present invention.

A textile in a textile inkjet printing device is a woven or non-woven textile. A textile is preferably selected from the group consisting of cotton textiles, silk textiles, flax textiles, jute textiles, hemp textiles, modal textiles, bamboo fibre textiles, pineapple fibre textiles, basalt fibre textiles, ramie textiles, polyester based textiles, acrylic based textiles, glass fibre textiles, aramid fibre textiles, polyurethane textiles, high density polyethylene textiles and mixtures thereof.

The textile may be transparent, translucent or opaque.

A major advantage of the present invention is that printing can be performed on a wide range of textiles. Suitable textiles can be made from many materials. These materials come from four main sources: animal (e.g. wool, silk), plant (e.g. cotton, flax, jute), mineral (e.g. asbestos, glass fibre), and synthetic (e.g. nylon, polyester, acrylic). Depending on the type of material, it can be knitted, woven or non-woven textile.

The textile is preferably selected from the group consisting of cotton textiles, silk textiles, flax textiles, jute textiles, hemp textiles, modal textiles, bamboo fibre textiles, pineapple fibre textiles, basalt fibre textiles, ramie textiles, polyester based textiles, acrylic based textiles, glass fibre textiles, aramid fibre textiles, polyurethane textiles (e.g. Spandex or Lycra™), high density polyethylene textiles (Tyvek™) and mixtures thereof. Suitable polyester textile includes polyethylene terephthalate textile, cation dyeable polyester textile, acetate textile, diacetate textile, triacetate textile, polylactic acid textile and the like.

Applications of these textiles include automotive textiles, canvas, banners, flags, interior decoration, clothing, swimwear, sportswear, ties, scarves, hats, floor mats, doormats, carpets, mattresses, mattress covers, linings, sacking, upholstery, carpets, curtains, draperies, sheets, pillowcases, flame-retardant and protective fabrics, and the like. In a preferred embodiment the present invention is comprised in the manufacturing of one of these applications. Polyester fibre is used in all types of clothing, either alone or blended with fibres such as cotton. Aramid fibre (e.g. Twaron) is used for flame-retardant clothing, cut-protection, and armour. Acrylic is a fibre used to imitate wools.

It is found that in the present invention the jetted ink or liquid penetrates easier in the fibres of a textile, probably by the distribution of the air-cups in the dimple pattern and the air sucking power in these air-cups.

Leather Inkjet Printing Device

Preferably the inkjet printing device (50) is a leather inkjet printing device, performing a leather inkjet printing method. The handling of such inkjet receivers (200) on a vacuum belt is difficult due to uncontrolled adhering of the inkjet receiver (200) against the vacuum belt due to easy crinkle of the inkjet receiver (200) while transporting and/or heat upon the surface of the leather, for example in a hot print zone and/or hot curing zone This crinkle effect on the inkjet receiver (200) can not be hold down and hold flat on current vacuum belts so the inkjet receiver (200) may touch against a printhead (75) from the inkjet printing device (50). Also crinkled leather is not acceptable for sale for example by bad print quality if the leather was not flat while printed. If no extra guiding means are implemented in the inkjet printing device (50) to hold down and flat the leather which introduces an extra manufacturing cost. For example in a hot printing area and/or hot curing area, if available, the crinkle effect of the leather can be become bigger. But in the present invention the connection, the hold-down and flat-down, of the inkjet receiver (200) with the vacuum belt is guaranteed even in these hot printing area and/or curing area, if available, from the inkjet printing device (50). The present invention has also the advantage that no imprinting exists of the dimple pattern in the leather after printing. The leather is preferably pre-treated by corona treatment by corona discharge equipment because some leathers, such as artificial leathers; have chemically inert and nonporous surfaces leading to a low surface energy. Also some leathers also have issues with shrinkage which is avoided by the present invention by a good overall coupling of the leather on the vacuum belt. This is a very high advantage for a leather inkjet printing device. Artificial leather is a fabric intended to substitute leather in fields such as upholstery, clothing, and fabrics, and other uses where a leather-like finish is required but the actual material is cost-prohibitive, unsuitable, or unusable for ethical reasons.

Artificial leather is marketed under many names, including "leatherette", "faux leather", and "pleather". Suitable artificial leather includes poromeric imitation leather, corfam, koskin and leatherette. Suitable commercial brands include Biothane™ from BioThane Coated Webbing, Birkibuc™ and Birko-Flor™ from Birkenstock, Kydex™ from Kleerdex, Lorica™ from Lorica Sud, and Fabrikoid™ from DuPont. Applications of these leathers include upholstery, clothing, shoes and the like. In a preferred embodiment the present invention is comprised in the manufacturing of one of these applications.

Corrugated Fibreboard Inkjet Printing Device

Preferably the inkjet printing device (50) is a corrugated fibreboard inkjet printing device, performing a corrugated fibreboard inkjet printing method. The inkjet receiver (200) of such inkjet printing device is always corrugated fibreboard. Corrugated fibreboard is a paper-based material consisting of a fluted corrugated medium and one or two flat linerboards. The corrugated medium and linerboard board are preferably made of kraft containerboard and/or preferably corrugated fibreboard is between 3 mm and 15 mm thick. Corrugated fibreboard is sometimes called corrugated cardboard; although cardboard might be any heavy paper-pulp based board. The handling of such inkjet receivers (200) on a vacuum belt is difficult due to uncontrolled adhering of the inkjet receiver (200) against the vacuum belt. Differences of humidity in bottom and top layer of the inkjet receiver (200) may cause a curvature effect on the inkjet receiver (200) which can not be hold down on current vacuum belts so the inkjet receiver (200) may crash against a printhead (75) from the inkjet printing device (50). If no extra guiding means are implemented in the inkjet printing device (50) to hold down the corrugated fibreboard which introduces an extra manufacturing cost. For example in a hot printing area and/or hot curing area, if available, the differences of humidity in bottom and top layer of the corrugated fibreboard can be become bigger. But in the present invention the connection, the hold-down, of the inkjet receiver (200) with the vacuum belt is guaranteed even in these hot printing area and/or curing area, if available, from the inkjet printing device (50).

Plastic Foil Inkjet Printing Device

Preferably the inkjet printing device (50) is a plastic foil inkjet printing device, performing a plastic foil inkjet printing method. The inkjet receiver (200) of such inkjet printing device is always plastic foil, such as polyvinyl chloride (PVC), polyethylene (PE), low density polyethylene (LDPE), polyvinylidene chloride (PVdC). The thickness of a plastic foil is preferably between 30 and 200 μm, more preferably between 50 and 100 μm and most preferably between 60 to 80 μm. In a preferred embodiment the plastic foil is suitable for making plastic bags.

The handling of such inkjet receivers (200) on a vacuum belt is difficult due to uncontrolled adhering of the inkjet receiver (200) against the vacuum belt due to easy crinkle of the inkjet receiver (200) while transporting and/or heat upon the surface of the plastic foil, for example in a hot print zone and/or hot curing zone This crinkle effect on the inkjet receiver (200) can not be hold down and hold flat on current vacuum belts so the inkjet receiver (200) may touch against a printhead (75) from the inkjet printing device (50). Also crinkled plastic foil is not acceptable for sale for example by bad print quality if the plastic foil was not flat while printed. If no extra guiding means are implemented in the inkjet printing device (50) to hold down and flat the plastic foil which introduces an extra manufacturing cost. For example in a hot printing area and/or hot curing area, if available, the crinkle effect of the plastic foil can be become bigger. But in the present invention the connection, the hold-down and flat-down, of the inkjet receiver (200) with the vacuum belt is guaranteed even in these hot printing area and/or curing area, if available, from the inkjet printing device (50). The present invention has also the advantage that no imprinting exists of the dimple pattern in the plastic foil after printing. The plastic foil is preferably pre-treated by corona treatment by corona discharge equipment because most plastics, such as polyethylene and polypropylene, have chemically inert and nonporous surfaces leading to a low surface energy.

Decoration Inkjet Printing Device

Preferably the inkjet printing device (50) is a decoration inkjet printing device, performing a decoration inkjet printing method, to create digital printed wallpaper, laminate, digital printed objects such as flat workpieces, bottles, butter boats or crowns of bottles.

Especially the present invention is has a big advantage in the manufacturing of decorative laminates wherein thermo-resin impregnated substrate, to print on, is brittle to transport underneath a printhead (75) and hot printing zones and/or curing zones may make the thermo-resin impregnated substrate unstable, such as shrinkage. In the present invention the connection, the hold-down and flat-down, of the thermosetting resin impregnated substrate with the vacuum belt is guaranteed even in these hot printing area and/or curing area from the inkjet printing device, used in the manufacturing of decorative laminates. So a preferred embodiment is a manufacturing method of decorative laminates comprising the present invention and/or using the present invention. It is found that in the present invention the jetted ink or liquid penetrates easier in the fibres of the thermosetting resin impregnated substrate, probably by the distribution of the air-cups in the dimple pattern and the air sucking power in these air-cups. Also the dimensional changes are minimized in the hot area of a printing zone and/or curing zone.

Corona Discharge Equipment

Corona discharge equipment consists of a high-frequency power generator, a high-voltage transformer, a stationary electrode, and a treater ground roll. Standard utility electrical power is converted into higher frequency power which is then supplied to the treater station. The treater station applies this power through ceramic or metal electrodes over an air gap onto the material's surface.

A corona treatment can be applied in the present invention to unprimed inkjet receivers (200), but also to primed inkjet receivers (200).

Vacuum Chamber (450)

A vacuum chamber (450) is a rigid enclosure which is constructed by many materials preferably it may comprise a metal. The choice of the material is based on the strength, pressure and the permeability. The material of the vacuum chamber (450) may comprise stainless steel, aluminium, mild steel, brass, high density ceramic, glass or acrylic.

A vacuum pump provides a vacuum pressure inside a vacuum chamber and is connected by a vacuum pump connector, such as a tube, to a vacuum pump input such as aperture in the vacuum chamber. Between the vacuum pump connector a vacuum controller, such as a valve or a tap, may be provided to control the vacuum in a sub-vacuum chamber wherein the aperture is positioned.

To prevent contamination, such as paper dust, inkjet receiver (200) fibers, ink, ink residues and/or ink debris such as cured ink, to contaminate via the set of air-channels (605) of the printing table and/or the set of vacuum-belt-air-channels (505) from the conveyor belt (100) the interior means of the vacuum pump, a filter, such as an air filter and/or coalescence filter, may be connected to the vacuum pump connector. Preferably a coalescence filter, as filter, is connected to the vacuum pump connector to split liquid and air from the contamination in the vacuum pump connector.

Vacuum Table

To avoid registration problems while printing on an inkjet receiver (200) and to avoid collisions while conveying an inkjet receiver (200), the inkjet receiver (200) needs to be connected to a printing table. A vacuum table (400) is a printing table wherein the inkjet receiver (200) is connected to the printing table by vacuum pressure. A vacuum table (400) is also called a porous printing table. Between the inkjet receiver (200) and the vacuum table (400) may be a vacuum belt (100) when a vacuum belt (100) is wrapped around the vacuum table (400).

Preferably the vacuum table (400) in an embodiment comprises a set of air-channels to provide a pressure differential by a vacuum chamber at the support layer of the vacuum table (400) to create a vacuum zone and at the bottom-surface of the printing table a set of apertures which are connected to the set of air-channels. These apertures at the bottom layer may be circular, elliptical, square, rectangular shaped and/or grooves, such as slits, parallel with the bottom layer of the vacuum table (400).

The width or height of the vacuum table (400) is preferably from 1.0 m until 10 m. The larger the width and/or height, the larger the inkjet receiver (200) may be supported by the vacuum table (400) which is an economical benefit.

An aperture at the bottom-surface and at the support surface of the vacuum table (400) may be connected to one or more air-channels. An aperture at the bottom-surface or support surface of the vacuum table (400) may be small in size, preferably from 0.3 to 12 mm in diameter, more preferably from 0.4 to 8 mm in diameter, most preferably from 0.5 to 5 mm in diameter and preferably spaced evenly apart on the vacuum belt (100) preferably 1 mm to 50 mm apart, more preferably from 4 to 30 mm apart and most preferably from 5 to 15 mm apart to enable the creation of uniform vacuum pressure that connects an inkjet receiver (200) together with the vacuum table (400).

A set of apertures at the support layer of the vacuum table (400) may be connected to the air-channels. These apertures at the support layer may be circular, elliptical, square, rectangular shaped and/or grooves, such as slits, parallel with the support layer of the vacuum table (400). Preferably, if the apertures are grooves, the grooves are oriented along the printing direction of the inkjet printing device.

Preferably the vacuum table (400) of an embodiment comprising a honeycomb structure plate (430) which is sandwiched between a top and bottom sandwich plate (600) which comprises each a set of apertures connect to one or more air-channels in the vacuum table (400). The honeycomb cores, as part of the air-channels, in the honeycomb structure plate (430) results in a better uniform vacuum distribution on the support surface of the vacuum table (400).

The dimensions and the amount of air-channels should be sized and frequently positioned to provide sufficient vacuum pressure to the vacuum table (400). Also the dimensions and the amount of apertures at the bottom-surface of the vacuum table (400) should be sized and frequently positioned to provide sufficient vacuum pressure to the vacuum table (400). The dimension between two air-channels or two apertures at the bottom-surface of the vacuum table (400) may be different. A honeycomb core is preferably sinusoidal or hexagonal shaped.

If a honeycomb structure plate (430) is comprised in the vacuum table (400) also the dimensions and the amount of honeycomb cores should be sized and frequently positioned to provide sufficient vacuum pressure to the vacuum table (400). The dimensions between two neighbour honeycomb cores may be different.

The support layer of the printing table should be constructed to prevent damaging of an inkjet receiver (200) or vacuum belt (100) if applicable. For example the apertures at the support layer that are connected with the air-channels may have rounded edges. The support layer of the printing table may be configured to have low frictional specifications.

The vacuum table (400) is preferably parallel to the ground whereon the inkjet printing system is connected to avoid misaligned printed patterns.

The vacuum pressure in a vacuum zone on the support surface of the vacuum table (400) may couple the inkjet receiver (200) and the vacuum table (400) by sandwiching the vacuum belt (100) that carries the inkjet receiver (200). The coupling is preferably done while printing to hold down the inkjet receiver (200) to avoid bad alignment and color-on-color register problems. The vacuum pressure in a vacuum zone on the support surface of the vacuum table (400) may apply sufficient normal force to the vacuum belt (100) when the vacuum belt (100) is moving and carrying an inkjet receiver (200) in the conveying direction. The vacuum pressure may also prevent any fluttering and/or vibrating of the vacuum belt (100) or inkjet receiver (200) on the vacuum belt (100). The vacuum pressure in a vacuum zone may be adapted while printing.

The top-surface of the vacuum table or a portion of the vacuum table, such as the inner side of its air-channels may be coated to have easy cleaning performances e.g. as result of dust or ink leaks. The coating is preferably a dust repellent and/or ink repellent and/or hydrophobic coating. Preferably the top-surface of the vacuum table or a portion of the vacuum table, such as the inner side of its air-channels, is treated with an ink repelling hydrophobic method by creating a lubricious and repelling surface which reduces friction.

Vacuum-Belt-Air-Channel (500)

A vacuum-belt-air-channel (500) is an air-channel from the top-surface (106) to the bottom-surface (108) of the conveyor belt (100). It is also called a suction-hole if the perimeter of the vacuum-belt-air-channel (500) at the top-surface (106) is substantially circular.

The area of a vacuum-belt-air-channel (500) at the top-surface (106) of the vacuum belt (100) is in the present invention preferably between 0.3 $mm^2$ and 5 $mm^2$. More preferably the perimeter of the vacuum-belt-air-channel (500) at the top-surface (106) has the same shape as a circle, ellipse, oval, rectangle, triangle, square, rectangle, pentagon, hexagon, heptagon, octagon or any polygon containing at least three sides.

The vacuum-belt-air-channel (500) is preferably tapered in the direction of the bottom-surface (108) for optimal vacuum pressure effect at the top-surface (106).

The perimeter of a suction-hole is preferably from 0.3 to 10 mm in diameter, more preferably from 0.4 to 5 mm in diameter, most preferably from 0.5 to 2 mm in diameter The vacuum-belt-air-channels in the air-sucking zone (105) are preferably spaced evenly apart on the vacuum belt (100) preferably 3 mm to 50 mm apart, more preferably from 4 to 30 mm apart and most preferably from 5 to 15 mm apart to enable the creation of uniform vacuum pressure that holds the inkjet receiver (200) together with the vacuum belt (100). Smaller the apertures in the vacuum belt (100), higher the vacuum pressure at the top of the vacuum belt (100).

It was found that in a vacuum belt (100) which comprises a carcass in glass fabric and holes smaller than 3 mm gives a superb vacuum to hold down the inkjet receiver (200) versus the state-of-the-art. The advantage of glass fabric web versus other fabric web, as carcass in a vacuum belt (100), makes it easier to drill small holes smaller than 3 mm in diameter without remaining fibers at the edges of the holes after drilling. If fibers remain at the edges of the holes, the vacuum pressure is influenced badly to hold down the ink receivers (200).

Vacuum-belt-air-channel is preferably drilled, perforated or cut in the conveyor belt but also a laser may form a vacuum-belt-air-channel in a conveyor belt.

Vacuum Belt (100)

Preferably the vacuum belt (100) has two or more layers of materials wherein an under layer provides linear strength and shape, also called the carcass and an upper layer called the cover or the support side. The carcass is preferably a woven fabric web and more preferably a woven fabric web of polyester, nylon, glass fabric or cotton. The material of the cover is preferably various rubber and more preferably plastic compounds and most preferably thermoplastic polymer resins. But also other exotic materials for the cover can be used such as silicone or gum rubber when traction is essential. An example of a multi-layered conveyor belt for a general belt conveyor system wherein the cover having a gel coating is disclosed in US 20090098385 A1 (FORBO SIEBLING GMBH).

Preferably the vacuum belt (100) comprises glass fabric or the carcass is glass fabric and more preferably the glass fabric, as carcass, has a coated layer on top comprising a thermoplastic polymer resin and most preferably the glass fabric has a coated layer on top comprising polyethylene terephthalate (PET), polyamide (PA), high-density polyethylene (HDPE), polytetrafluoroethylene (PTFE), polyoxymethylene (POM), polyurethaan (PU) and/or Polyaryletherketone (PAEK). The coated layer may also comprise aliphatic polyamides, polyamide 11 (PA 11), polyamide 12 (PA 12), UHM-HDPE, HM-HDPE, Polypropylene (PP), Polyvinyl chloride (PVC), Polysulfone (PS), Poly(p-phenylene oxide) (PPOTM), Polybutylene terephthalate (PBT), Polycarbonate (PC), Polyphenylene sulphide (PPS).

Preferably the vacuum belt (100) is and endless vacuum belt. Examples and figures for manufacturing an endless multi-layered vacuum belt (100) for a general belt conveyor system are disclosed in EP 1669635 B (FORBO SIEBLING GMBH).

The vacuum belt (100) may also have a sticky cover which holds the inkjet receiver (200) on the vacuum belt (100) while it is carried from start location to end location. Said vacuum belt (100) is also called a sticky vacuum belt (100). The advantageous effect of using a sticky vacuum belt (100) allows an exact positioning of an inkjet receiver (200) on the sticky vacuum belt (100). Another advantageous effect is that the inkjet receiver (200) shall not be stretched and/or deformed while the inkjet receiver (200) is carried from start location to end location. The adhesive on the cover is preferably activated by an infrared drier to make the vacuum belt (100) sticky. The adhesive on the cover is more preferably a removable pressure sensitive adhesive. The combination of sticky belt with a vacuum belt comprising a set of dimples each forming air-cups gives a boost at the technology in vacuum belts for inkjet printing devices, especially for textile inkjet printing devices.

Another preferable way of a sticky vacuum belt (100) is a vacuum belt (100) which comprises synthetic setae to hold an inkjet receiver (200) stable, e.g. not formable, while printing on an inkjet receiver (200). Holding the inkjet receiver (200) stable while printing on the inkjet receiver (200) is necessary e.g. to avoid misalignment or color shifts in the printed pattern on the inkjet receiver (200). The synthetic setae are emulations of setae found on the toes of geckos.

The top-surface of the vacuum belt or a portion of the vacuum belt, such as its air-channels, may be coated to have easy cleaning as result of e.g. dust or ink leaks. The coating is preferably a dust repellent and/or ink repellent and/or hydrophobic coating. Preferably the top-surface of the vacuum belt or a portion of the vacuum, belt is treated with an ink repelling hydrophobic method by creating a lubricious and repelling surface which reduces friction.

A layer of neutral fibres in the vacuum belt is preferably constructed at a distance from the bottom surface between 2 mm and 0.1 mm, more preferably between 1 mm and 0.3 mm. This layer with neutral fibres is of big importance to have a straight conveying direction with minimal side force on the vacuum belt and/or minimized fluctuation of the Pitch Line of the vacuum belt for high printing precision transportation.

The top surface of the vacuum belt comprises preferable hard urethane with a preferred thickness (measured from top surface (106) to bottom surface (108)) between 0.2 to 2.5 mm. The total thickness (measured from top surface (106) to bottom surface (108)) of the vacuum belt is preferably between 1.2 to 7 mm. The top-surface is preferably high resistance to solvents so the inkjet printing device is useful in an industrial printing and/or manufacturing environment.

Manufacturing Methods of Decorative Laminates

A manufacturing method of decorative laminates, performed by the inkjet printing device of the present invention, may include the steps of: a) forming a decorative layer by jetting ink droplets having a volume of up to 30 pL of one or more aqueous pigmented inkjet inks onto the semi-dried or dried ink acceptance layer; and b) heat pressing the decorative layer into a decorative laminate; and preferably prior step a) a step of supplying an ink acceptance layer onto a paper substrate preferably by jetting droplets having a volume of 1 to 200 nL; wherein the ink acceptance layer preferably contains an inorganic pigment P and a polymeric binder B in a weight ratio P/B larger than 1.5.

Preferably the paper substrate is first impregnated by a thermosetting resin and then an ink acceptance layer is printed onto the impregnated paper substrate. The advantage thereof is that a perfect match between decorative pattern and an embossed wood grain can be easily achieved, because the impregnated paper substrate is dimensionally stable. The embossing of a relief into the decorative laminate is preferably combined with step b) of heat pressing the decorative layer into a decorative laminate.

In a preferred embodiment of this manufacturing method, the one or more aqueous pigmented inkjet inks include at least three aqueous pigmented inkjet inks containing one or more pigments selected from the group consisting of carbon black, C.I. Pigment Blue 15:3, C.I. Pigment Blue 15:4, C.I Pigment Yellow 150, C.I Pigment Yellow 151, C.I. Pigment Yellow 180, C.I. Pigment Yellow 74, C.I Pigment Red 254, C.I. Pigment Red 176, C.I. Pigment Red 122, and mixed crystals thereof.

In a preferred embodiment, the ink acceptance layer containing an inorganic pigment and a polymeric binder has a weight ratio P/B of inorganic pigment to binder of larger than 3.0, preferably 3.5 or more.

The thermosetting resin provided paper is preferably dried before applying an ink acceptance layer and before inkjet printing, preferably to a residual humidity of 10% or less. In this case the most important portion of the expansion or shrinkage of the paper layer is neutralized.

Decorative Laminates

In a preferred embodiment, the decorative laminate includes a tongue and a groove capable of achieving a glue less mechanical joint.

The decorative laminates, especially decorative panels, may further include a sound-absorbing layer as disclosed by U.S. Pat. No. 8,196,366 (UNILIN).

In a preferred embodiment, the decorative panel is an antistatic layered panel. Techniques to render decorative panels antistatic are well-known in the art of decorative laminates as exemplified by EP 1567334 A (FLOORING IND).

The top-surface of the decorative laminate, i.e. at least the protective layer, is preferably provided with a relief matching the colour pattern, such as for example the wood grain, cracks and knots in a woodprint. Embossing techniques to accomplish such relief are well-known and disclosed by, for example, EP 1290290 A (FLOORING IND), US 2006144004 (UNILIN), EP 1711353 A (FLOORING IND) and US 2010192793 (FLOORING IND).

Most preferably the relief is formed by pressing a digital embossing plate against the top layer of the decorative workpiece or nested decorative workpiece.

A digital embossing plate is a plate which comprises elevations that can be used to form a relief on decorative workpiece by pressing the digital embossing plate against the top layer of the decorative workpiece or nested decorative workpiece. The elevations are cured inkjet droplets, jetted by an inkjet print device, and most preferably UV cured inkjet droplets. The elevations are preferably formed by printing and curing inkjet droplets on top of already cured or pin-cured inkjet droplets. The plate is preferably stiff by using metal or hard plastic.

An alternative of a digital embossing plate may be a digital embossing cylinder which is a cylinder that comprises the elevations to form a relief on decorative workpieces by pressing and rotating the digital embossing cylinder against the top layer of the decorative workpiece or nested decorative workpiece. The elevations on the digital embossing cylinder are cured inkjet droplets, jetted by an inkjet print device, and most preferably UV cured inkjet droplets. The elevations are preferably formed by printing and curing inkjet droplets on top of already cured or pin-cured inkjet droplets.

In a preferred embodiment, the decorative panels are made in the form of rectangular oblong strips. The dimensions thereof may vary greatly. Preferably the panels have a length exceeding 1 meter, and a width exceeding 0.1 meter, e.g. the panels can be about 1.3 meter long and about 0.15 meter wide. According to a special embodiment the length of the panels exceeds 2 meter, with the width being preferably about 0.2 meter or more. The print of such panels is preferably free from repetitions.

Core Layers

The core layer of a decorative panel is preferably made of wood-based materials, such as particle board, MDF or HDF (Medium Density Fibreboard or High Density Fibreboard), Oriented Strand Board (OSB) or the like. Also, use can be made of boards of synthetic material or boards hardened by means of water, such as cement boards. In a particularly preferred embodiment, the core layer is a MDF or HDF board.

The core layer may also be assembled at least from a plurality of paper sheets, or other carrier sheets, impregnated with a thermosetting resin as disclosed by WO 2013/050910 (UNILIN). Preferred paper sheets include so-called Kraft paper obtained by a chemical pulping process also known as the Kraft process, e.g. as described in U.S. Pat. No. 4,952,277 (BET PAPERCHEM).

In another preferred embodiment, the core layer is a board material composed substantially of wood fibres which are bonded by means of a polycondensation glue, wherein the polycondensation glue forms 5 to 20 percent by weight of the board material and the wood fibres are obtained for at least 40 percent by weight from recycled wood. Suitable examples are disclosed by EP 2374588 A (UNILIN).

Instead of a wood based core layer, also a synthetic core layer may be used, such as those disclosed by US 2013062006 (FLOORING IND). In a preferred embodiment, the core layer comprises a foamed synthetic material, such as foamed polyethylene or foamed polyvinyl chloride.

Other preferred core layers and their manufacturing are disclosed by US 2011311806 (UNILIN) and U.S. Pat. No. 6,773,799 (DECORATIVE SURFACES).

The thickness of the core layer is preferably between 2 and 12 mm, more preferably between 5 and 10 mm.

Paper Substrates

The decorative layer and preferably, if present also the protective layer and/or balancing layer, include paper as substrate.

The paper preferably has a weight of less than 150 g/m$^2$, because heavier paper sheets are hard to impregnate all through their thickness with a thermosetting resin. Preferably said paper layer has a paper weight, i.e. without taking into account the resin provided on it, of between 50 and 130 g/m$^2$ and preferably between 70 and 130 g/m$^2$. The weight of the paper cannot be too high, as then the amount of resin needed to sufficiently impregnate the paper would be too high, and reliably further processing the printed paper in a pressing operation becomes badly feasible.

Preferably, the paper sheets have porosity according to Gurley's method (DIN 53120) of between 8 and 25 seconds. Such porosity allows even for a heavy sheet of more than 150 g/m$^2$ to be readily impregnated with a relatively high amount of resin.

Suitable paper sheets having high porosity and their manufacturing are also disclosed by U.S. Pat. No. 6,709,764 (ARJO WIGGINS).

The paper for the decorative layer is preferably a white paper and may include one or more whitening agents, such as titanium dioxide, calcium carbonate and the like. The presence of a whitening agent helps to mask differences in colour on the core layer which can cause undesired colour effects on the colour pattern.

Alternatively, the paper for the decorative layer may be a bulk coloured paper including one or more colour dyes and/or colour pigments. Besides the masking of differences in colour on the core layer, the use of a coloured paper reduces the amount of inkjet ink required to print the colour pattern. For example, a light brown or grey paper may be used for printing a wood motif as colour pattern in order to reduce the amount of inkjet ink needed.

In a preferred embodiment, unbleached Kraft paper is used for a brownish coloured paper in the decorative layer. Kraft paper has a low lignin content resulting in a high tensile strength. A preferred type of Kraft paper is absorbent Kraft paper of 40 to 135 g/m$^2$ having a high porosity and made from clean low kappa hardwood Kraft of good uniformity.

If the protective layer includes a paper, then a paper is used which becomes transparent or translucent after resin impregnation so that for the colour pattern in the decorative layer can be viewed.

The above papers may also be used in the balancing layer.

For the sake of clarity, it should be clear that resin coated papers, so-called RC papers, are not the thermosetting resin impregnated papers of the decorative laminate manufacturing methods according to the invention. The RC papers used in home/office aqueous inkjet printing consist of a porous paper core free of resin. The RC papers have only on their surface a resin coating, usually a polyethylene or polypropylene resin coating, with thereon one or more ink receiving layers. Such RC papers have a low permeability for the thermosetting resin leading to inhomogeneous resin absorption and higher risk for delamination after pressing.

Thermosetting Resins

The thermosetting resin is preferably selected from the group consisting of melamine-formaldehyde based resins, ureum-formaldehyde based resins and phenol-formaldehyde based resins. Other suitable resins for impregnating the paper are listed in of EP 2274485 A (HUELSTA).

Most preferably the thermosetting resin is a melamine-formaldehyde based resin, often simply referred to in the art as a 'melamine (based) resin'.

The melamine formaldehyde resin preferably has a formaldehyde to melamine ratio of 1.4 to 2. Such melamine based resin is a resin that polycondensates while exposed to heat in a pressing operation. The polycondensation reaction creates water as a by-product. It is particularly with these kinds of thermosetting resins, namely those creating water as a by-product that the present invention is of interest. The created water, as well as any water residue in the thermosetting resin before the pressing, must leave the hardening resin layer to a large extent before being trapped and leading to a loss of transparency in the hardened layer. The available ink layer can hinder the diffusion of the vapour bubbles to the surface; however the present invention provides measures for limiting such hindrance.

The paper is preferably provided with an amount of thermosetting resin equaling 40 to 250% dry weight of resin as compared to weight of the paper. Experiments have shown that this range of applied resin provides for a sufficient impregnation of the paper, that avoids splitting to a large extent, and that stabilizes the dimension of the paper to a high degree.

The paper is preferably provided with such an amount of thermosetting resin, that at least the paper core is satisfied with the resin. Such satisfaction can be reached when an amount of resin is provided that corresponds to at least 1.5 or at least 2 times the paper weight. Preferably the paper is firstly impregnated through or satisfied, and, afterwards, at least at the side thereof to be printed, resin is partially removed.

Preferably the resin provided on said paper is in a B-stage while printing. Such B-stage exists when the thermosetting resin is not completely cross linked.

Preferably the resin provided on said paper has a relative humidity lower than 15%, and still better of 10% by weight or lower while printing.

Preferably the step of providing said paper with thermosetting resin involves applying a mixture of water and the resin on the paper. The application of the mixture might involve immersion of the paper in a bath of the mixture. Preferably the resin is provided in a dosed manner, for example by using one or more squeezing rollers and/or doctor blades to set the amount of resin added to the paper layer.

Methods for impregnating a paper substrate with resin are well-known in the art as exemplified by WO 2012/126816 (VITS) and EP 966641 A (VITS).

The dry resin content of the mixture of water and resin for impregnation depends on the type of resin. An aqueous solution containing a phenol-formaldehyde resin preferably has a dry resin content of about 30% by weight, while an aqueous solution containing a melamine-formaldehyde resin preferably has a dry resin content of about 60% by weight. Methods of impregnation with such solutions are disclosed by e.g. U.S. Pat. No. 6,773,799 (DECORATIVE SURFACES).

The paper is preferably impregnated with the mixtures known from U.S. Pat. No. 4,109,043 (FORMICA CORP) and U.S. Pat. No. 4,112,169 (FORMICA CORP), and hence preferably comprise, next to melamine formaldehyde resin, also polyurethane resin and/or acrylic resin.

The mixture including the thermosetting resin may further include additives, such as colorants, surface active ingredients, biocides, antistatic agents, hard particles for wear resistance, elastomers, UV absorbers, organic solvents, acids, bases, and the like.

The advantage of adding a colorant to the mixture containing the thermosetting resin is that a single type of white paper can be used for manufacturing the decorative layer, thereby reducing the stock of paper for the decorative laminate manufacturer. The use of a colored paper, as already described above, to reduce the amount of ink required for printing a wood motif, is here accomplished by the white paper being colored by impregnation by a brownish thermosetting resin. The latter allows a better control of the amount of brown colour required for certain wood motifs.

Antistatic agents may be used in thermosetting resin. However preferably antistatic agents, like NaCl and KCl, carbon particles and metal particles, are absent in the resin, because often they have undesired side effects such as a lower water resistance or a lower transparency. Other suitable antistatic agents are disclosed by EP 1567334 A (FLOORING IND).

Hard particles for wear resistance are preferably included in a protective layer.

Ink Acceptance Layers

The ink acceptance layer contains an inorganic pigment and a polymeric binder having a weight ratio P/B of inorganic pigment P to polymeric binder B of larger than 1.5, preferably larger than 3.0. The inorganic pigment may be a single type of inorganic pigment or a plurality of different inorganic pigments. The polymeric binder may be a single type of polymeric binder or a plurality of different polymeric binders.

In a preferred embodiment, the ink acceptance layer has a total dry weight between 2.0 g/m$^2$ and 10.0 g/m$^2$, more preferably between 3.0 and 6.0 g/m$^2$.

The thickness of the ink acceptance layer may vary over the width of the paper substrate, for example, to compensate for inhomogeneities in the surface of the impregnated paper substrate causing image artifacts or to apply image wise more inorganic pigment. The latter may, for example, become necessary in dark brown areas of wood grain requiring high ink loads of aqueous pigmented inkjet ink. The variation of the thickness of the ink acceptance layer over the width of the paper substrate is preferably at least 10%, more preferably at least 20% of the thickness. A thickness difference of less than 10% generally has little effect in improving image quality.

In a preferred embodiment, the ink acceptance layer includes a polymeric binder selected from the group consisting of hydroxyethyl cellulose; hydroxypropyl cellulose; hydroxyethylmethyl cellulose; hydroxypropyl methyl cellulose; hydroxybutylmethyl cellulose; methyl cellulose; sodium carboxymethyl cellulose; sodium carboxymethylhydroxethyl cellulose; water soluble ethylhydroxyethyl cellulose; cellulose sulfate; polyvinyl alcohol; vinylalcohol copolymers; polyvinyl acetate; polyvinyl acetal; polyvinyl pyrrolidone; polyacrylamide; acrylamide/acrylic acid copolymer; polystyrene, styrene copolymers; acrylic or methacrylic polymers; styrene/acrylic copolymers; ethylene-vinylacetate copolymer; vinyl-methyl ether/maleic acid copolymer; poly(2-acrylamido-2-methyl propane sulfonic acid); poly(diethylene triamine-co-adipic acid); polyvinyl pyridine; polyvinyl imidazole; polyethylene imine epichlorohydrin modified; polyethylene imine ethoxylated; ether bond-containing polymers such as polyethylene oxide (PEO), polypropylene oxide (PPO), polyethylene glycol (PEG) and polyvinyl ether (PVE); polyurethane; melamine resins; gelatin; carrageenan; dextran; gum arabic; casein; pectin; albumin; chitins; chitosans; starch; collagen derivatives; collodion and agar-agar.

In a particularly preferred embodiment, the ink acceptance layer includes a polymeric binder, preferably a water soluble polymeric binder (>1 g/L water), which has a hydroxyl group as a hydrophilic structural unit, e.g. a polyvinyl alcohol.

A preferred polymer for the ink acceptance layer is a polyvinylalcohol (PVA), a vinylalcohol copolymer or modified polyvinyl alcohol. The modified polyvinyl alcohol may be a cationic type polyvinyl alcohol, such as the cationic polyvinyl alcohol grades from Kuraray, such as POVAL C506, POVAL C118 from Nippon Goshei.

The pigment in the ink acceptance layer is an inorganic pigment, which can be chosen from neutral, anionic and cationic pigment types. Useful pigments include e.g. silica, talc, clay, hydrotalcite, kaolin, diatomaceous earth, calcium carbonate, magnesium carbonate, basic magnesium carbonate, aluminosilicate, aluminum trihydroxide, aluminum oxide (alumina), titanium oxide, zinc oxide, barium sulfate, calcium sulfate, zinc sulfide, satin white, alumina hydrate such as boehmite, zirconium oxide or mixed oxides.

The inorganic pigment is preferably selected from the group consisting of alumina hydrates, aluminum oxides, aluminum hydroxides, aluminum silicates, and silicas.

Particularly preferred inorganic pigments are silica particles, colloidal silica, alumina particles and pseudo-boehmite, as they form better porous structures. When used herein, the particles may be primary particles directly used as they are, or they may form secondary particles. Preferably, the particles have an average primary particle diameter of 2 μm or less, and more preferably 200 nm or less.

A preferred type of alumina hydrate is crystalline boehmite, or γ-AlO(OH). Useful types of boehmite include DISPERAL HP14, DISPERAL 40, DISPAL 23N4-20, DISPAL 14N-25 and DISPERAL AL25 from Sasol; and MARTOXIN VPP2000-2 and GL-3 from Martinswerk GmbH Useful cationic aluminum oxide (alumina) types include $\alpha$-$Al_2O_3$ types, such as NORTON E700, available from Saint-Gobain Ceramics & Plastics, Inc, and $\gamma$-$Al_2O_3$ types, such as ALUMINUM OXID C from Degussa.

Other useful inorganic pigments include aluminum trihydroxides such as Bayerite, or $\alpha$-$Al(OH)_3$, such as PLURAL BT, available from Sasol, and Gibbsite, or $\gamma$-$Al(OH)_3$, such as MARTINAL grades and MARTIFIN grades from Martinswerk GmbH, MICRAL grades from J M Huber company; HIGILITE grades from Showa Denka K.K.

Another preferred type of inorganic pigment is silica which can be used as such, in its anionic form or after cationic modification. The silica can be chosen from different types, such as crystalline silica, amorphous silica, precipitated silica, fumed silica, silica gel, spherical and non-spherical silica. The silica may contain minor amounts of metal oxides from the group Al, Zr, Ti. Useful types include AEROSIL OX50 (BET surface area 50±15 $m^2/g$, average primary particle size 40 nm, $SiO_2$ content >99.8%, $Al_2O_3$ content <0.08%), AEROSIL MOX170 (BET surface area 170 $g/m^2$, average primary particle size 15 nm, $SiO_2$ content >98.3%, $Al_2O_3$ content 0.3-1.3%), AEROSIL MOX80 (BET surface area 80±20 $g/m^2$, average primary particle size 30 nm, $SiO_2$ content >98.3%, $Al_2O_3$ content 0.3-1.3%), or other hydrophilic AEROSIL grades available from Degussa-Hüls AG, which may give aqueous dispersions with a small average particle size (<500 nm).

Generally depending on their production method, silica particles are grouped into two types, wet-process particles and dry-process (vapour phase-process or fumed) particles.

In the wet process, active silica is formed through acidolysis of silicates, and this is polymerized to a suitable degree and flocculated to obtain hydrous silica.

A vapour-phase process includes two types; one includes high-temperature vapour-phase hydrolysis of silicon halide to obtain anhydrous silica (flame hydrolysis), and the other includes thermal reduction vaporization of silica sand and coke in an electric furnace followed by oxidizing it in air to also obtain anhydrous silica (arc process). The "fumed silica" means to indicate anhydrous silica particles obtained in the vapour-phase process.

For the silica particles used in the invention, especially preferred are the fumed silica particles. The fumed silica differs from hydrous silica in point of the density of the surface silanol group and of the presence or absence of pores therein, and the two different types of silica have different properties. The fumed silica is suitable for forming a three-dimensional structure of high porosity. Since the fumed silica has a particularly large specific surface area, its ink absorption and retention are high. Preferably, the vapour-phase silica has an average primary particle diameter of 30 nm or less, more preferably 20 nm or less, even more preferably 10 nm or less, and most preferably from 3 to 10 nm. The fumed silica particles readily aggregate through hydrogen bonding at the silanol groups therein. Therefore, when their mean primary particle size is not larger than 30 nm, the silica particles may form a structure of high porosity.

In a further preferred embodiment, the ink acceptance layer may be crosslinked. Any suitable crosslinker known in the prior art can be used. Boric acid is particularly preferred as crosslinker for an ink acceptance layer containing polyvinylalcohol or vinylalcohol copolymer as polymeric binder.

The ink acceptance layer may include other additives, such as colorants, surfactants, biocides, antistatic agents, hard particles for wear resistance, elastomers, UV absorbers, organic solvents, plasticizers, light-stabilizers, pH adjusters, antistatic agents, whitening agents, matting agents and the like.

The ink acceptance layer may consist of a single layer or of two, three or more layers even having a different composition.

Printhead (75)

A printhead (75) is a means for jetting a liquid on a inkjet receiver (200) through a nozzle. The nozzle may be comprised in a nozzle plate which is attached to the printhead (75). A printhead (75) preferably has a plurality of nozzles which may be comprised in a nowwle plate. A set of liquid channels, comprised in the printhead (75), corresponds to a nozzle of the printhead (75) which means that the liquid in the set of liquid channels can leave the corresponding nozzle in the jetting method. The liquid is preferably an ink, more preferably an UV curable inkjet ink or water based inkjet ink, such as a water based resin inkjet ink. The liquid used to jet by a printhead (75) is also called a jettable liquid. A high viscosity jetting method with UV curable inkjet ink is called a high viscosity UV curable jetting method. A high viscosity jetting method with water based inkjet ink is called a high viscosity water base jetting method.

The way to incorporate printheads (75) into an inkjet printing device (50) is well-known to the skilled person.

A printhead (75) may be any type of printhead (75) such as a Valvejet printhead, Piezoelectric printhead, thermal printhead (75), a continuous printhead (75) type, electrostatic drop on demand printhead (75) type or acoustic drop on demand printhead (75) type or a page-wide printhead (75) array, also called a page-wide inkjet array.

A printhead (75) comprises a set of master inlets (101) to provide the printhead (75) with a liquid from a set of external liquid feeding units (300). Preferably the printhead (75) comprises a set of master outlets (111) to perform a recirculation of the liquid through the printhead (75). The recirculation may be done before the droplet forming means but it is more preferred that the recirculation is done in the printhead (75) itself, so called through-flow printheads (75). The continuous flow of the liquid in a through-flow printheads (75) removes air bubbles and agglomerated particles from the liquid channels of the printhead (75), thereby avoiding blocked nozzles that prevent jetting of the liquid. The continuous flow prevents sedimentation and ensures a consistent jetting temperature and jetting viscosity. It also facilitates auto-recovery of blocked nozzles which minimizes liquid and receiver (200) wastage.

The number of master inlets in the set of master inlets is preferably from 1 to 12 master inlets, more preferably from 1 to 6 master inlets and most preferably from 1 to 4 master inlets. The set of liquid channels that corresponds to the nozzle (500) are replenished via one or more master inlets of the set of master inlets.

The amount of master outlets in the set of master outlets in a through-flow printhead (75) is preferably from 1 to 12 master outlets, more preferably from 1 to 6 master outlets and most preferably from 1 to 4 master outlets.

In a preferred embodiment prior to the replenishing of a set of liquid channels, a set of liquids is mixed to a jettable liquid that replenishes the set of liquid channels. The mixing to a jettable liquid is preferably performed by a mixing means, also called a mixer, preferably comprised in the printhead (75) wherein the mixing means is attached to the set of master inlets and the set of liquid channels. The mixing means may comprise a stirring device in a liquid container, such as a manifold in the printhead (75), wherein the set of liquids are mixed by a mixer. The mixing to a jettable liquid also means the dilution of liquids to a jettable liquid. The late mixing of a set of liquids for jettable liquid has the benefit that sedimentation can be avoided for jettable liquids of limited dispersion stability.

The liquid leaves the liquid channels by a droplet forming means, through the nozzle that corresponds to the liquid channels. The droplet forming means are comprised in the printhead (75). The droplet forming means are activating the liquid channels to move the liquid out the printhead (75) through the nozzle that corresponds to the liquid channels.

The amount of liquid channels in the set of liquid channels that corresponds to a nozzle is preferably from 1 to 12, more preferably from 1 to 6 and most preferably from 1 to 4 liquid channels.

The printhead (75) of the present invention is preferably suitable for jetting a liquid having a jetting viscosity of 8 mPa·s to 3000 mPa·s. A preferred printhead (75) is suitable for jetting a liquid having a jetting viscosity of 20 mPa·s to 200 mPa·s; and more preferably suitable for jetting a liquid having a jetting viscosity of 50 mPa·s to 150 mPa·s.

Valvejet Printhead

A preferred printhead (75) for the present invention is a so-called Valvejet printhead. Preferred Valvejet printheads have a nozzle diameter between 45 and 600 μm. The Valvejet printheads comprising a plurality of micro valves, allow for a resolution of 15 to 150 dpi that is preferred for having high productivity while not comprising image quality. A Valvejet printhead is also called coil package of micro valves or a dispensing module of micro valves. The way to incorporate Valvejet printheads into an inkjet printing device is well-known to the skilled person. For example, US 2012105522 (MATTHEWS RESOURCES INC) discloses a valvejet printer including a solenoid coil and a plunger rod having a magnetically susceptible shank. Suitable commercial Valvejet printheads are chromoJET™ 200, 400 and 800 from Zimmer, Printos™ P16 from VideoJet and the coil packages of micro valve SMLD 300's from Fritz Gyger™. A nozzle plate of a Valvejet printhead is often called a faceplate and is preferably made from stainless steel.

The droplet forming means (103) of a Valvejet printhead controls each micro valve in the Valvejet printhead by actuating electromagnetically to close or to open the micro valve so that the medium flows through the liquid channel. Valvejet printheads preferably have a maximum dispensing frequency up to 3000 Hz.

In a preferred embodiment the Valvejet printhead the minimum drop size of one single droplet, also called minimal dispensing volume, is from 1 nL (=nanoliter) to 500 μL (=microliter), in a more preferred embodiment the minimum drop size is from 10 nL to 50 μL, in a most preferred embodiment the minimum drop size is from 10 nL to 300 μL. By using multiple single droplets, higher drop sizes may be achieved.

In a preferred embodiment the Valvejet printhead has a native print resolution from 10 DPI to 300 DPI, in a more preferred embodiment the Valvejet printhead has a native print resolution from 20 DPI to 200 DPI and in a most preferred embodiment the Valvejet printhead has a native print resolution from 50 DPI to 200 DPI.

In a preferred embodiment with the Valvejet printhead the jetting viscosity is from 8 mPa·s to 3000 mPa·s more preferably from 25 mPa·s to 1000 mPa·s and most preferably from 30 mPa·s to 500 mPa·s.

In a preferred embodiment with the Valvejet printhead the jetting temperature is from 10° C. to 100° C. more preferably from 20° C. to 60° C. and most preferably from 25° C. to 50° C.

Belt Step Conveyor System

An embodiment of the inkjet printing device comprises a vacuum belt, wrapped around the vacuum table (400), wherein the vacuum belt carries an inkjet receiver (200) by moving from a start location to an end location in preferably successive distance movements also called discrete step increments. This is also called a belt step conveyor system.

The belt step conveyor system may be driven by an electric stepper motor to produce a torque to a pulley so by friction of the vacuum belt on the powered pulley the vacuum belt and the inkjet receiver (200) is moved in a conveying direction. The use of an electric stepper motor makes the transport of a load more controllable e.g. to change the speed of conveying and move the load on the vacuum belt in successive distance movements. An example of a belt step conveying belt system with an electric stepper motor is described for the media transport of a wide-format printer in EP 1235690 A (ENCAD INC)

To known the distance of the successive distance movements in a belt step conveyor system, that is driven by an electric stepper motor to produce a torque to a pulley so by friction of the vacuum belt on the powered pulley the vacuum belt and the inkjet receiver (200) is moved in a conveying direction substrate on the vacuum belt, so it can be communicated to other controllers such as a renderer of the inkjet printing device or the controllers of a inkjet head, an encoder is comprised on one of the pulleys that are linked with the vacuum belt But preferably the encoder measures the linear feed of the vacuum belt directly on the vacuum belt by a measuring device comprising a position sensor that may attachable to the vacuum belt and a stationary reference means wherein the relative position of the position sensor to the stationary reference means is detected. The position sensor comprises preferably an optical sensor which may interpret the distance between the position sensor and the stationary reference means on a distance ruler, such as an encoder strip, which is preferably comprised at the stationary reference means. Preferably the measuring device comprises a gripper to grip the position sensor to the conveying belt. The measuring device may comprising a guide means through which the position sensor relative to the stationary reference means is guided—preferably linear. By attaching the position sensor to the vacuum belt while moving the vacuum belt in a conveying direction, the distance can be measured between the position sensor and the stationary reference means. Between the discrete steps increments the position sensor may release the vacuum belt and may return to the stationary reference.

To enhance the accuracy of this measuring device the vacuum table which may provide a set of vacuum zones, preferably related to a sub-vacuum chamber that is created by a moving vacuum divider, at an edge of the vacuum belt to correct the flatness, resilience, oblique movement correction, position of the vacuum belt on the pulleys and/or the tension of the vacuum belt by applying a different vacuum pressure in the vacuum zone at the edge of the vacuum belt.

Piezoelectric Printheads

Another preferred printhead (75) for the present invention is a Piezoelectric printhead. Piezoelectric printhead, also called piezoelectric inkjet printhead (75), is based on the movement of a piezoelectric ceramic transducer, comprised in the printhead (75), when a voltage is applied thereto. The application of a voltage changes the shape of the piezoelectric ceramic transducer to create a void in a liquid channel, which is then filled with liquid. When the voltage is again removed, the ceramic expands to its original shape, ejecting a droplet of liquid from the liquid channel.

The droplet forming means of a Piezoelectric printhead controls a set of piezoelectric ceramic transducers to apply a voltage to change the shape of a piezoelectric ceramic transducer. The droplet forming means may be a squeeze mode actuator, a bend mode actuator, a push mode actuator or a shear mode actuator or another type of piezoelectric actuator.

Suitable commercial Piezoelectric printheads are TOSHIBA TEC™ CK1 and CK1L from TOSHIBA TEC™ (https://www.toshibatec.co.jp/en/products/industrial/inkjet/products/cfl/) and XAAR™ 1002 from XAAR™ (http://www.xaar.com/en/products/xaar-1002).

A liquid channel in a Piezoelectric printhead is also called a pressure chamber.

Between a liquid channel and a master inlet of the Piezoelectric printheads, there is a manifold connected to store the liquid to supply to the set of liquid channels.

The Piezoelectric printhead is preferably a through-flow Piezoelectric printhead. In a preferred embodiment the recirculation of the liquid in a through-flow Piezoelectric printhead flows between a set of liquid channels and the inlet of the nozzle wherein the set of liquid channels corresponds to the nozzle (500).

In a preferred embodiment in a Piezoelectric printhead the minimum drop size of one single jetted droplet is from 0.1 μL to 300 μL, in a more preferred embodiment the minimum drop size is from 1 μL to 30 μL, in a most preferred embodiment the minimum drop size is from 1.5 μL to 15 μL. By using grayscale inkjet head technology multiple single droplets may form larger drop sizes.

In a preferred embodiment the Piezoelectric printhead has a drop velocity from 3 meters per second to 15 meters per second, in a more preferred embodiment the drop velocity is from 5 meters per second to 10 meters per second, in a most preferred embodiment the drop velocity is from 6 meters per second to 8 meters per second.

In a preferred embodiment the Piezoelectric printhead has a native print resolution from 25 DPI to 2400 DPI, in a more preferred embodiment the Piezoelectric printhead has a native print resolution from 50 DPI to 2400 DPI and in a most preferred embodiment the Piezoelectric printhead has a native print resolution from 150 DPI to 3600 DPI.

In a preferred embodiment with the Piezoelectric printhead the jetting viscosity is from 8 mPa·s to 200 mPa·s more preferably from 25 mPa·s to 100 mPa·s and most preferably from 30 mPa·s to 70 mPa·s.

In a preferred embodiment with the Piezoelectric printhead the jetting temperature is from 10° C. to 100° C. more preferably from 20° C. to 60° C. and most preferably from 30° C. to 50° C.

The nozzle spacing distance of the nozzle row in a Piezoelectric printhead is preferably from 10 μm to 200 μm; more preferably from 10 μm to 85 μm; and most preferably from 10 μm to 45 μm.

Inkjet Ink

In a preferred embodiment, the liquid in the printhead (75) is an aqueous curable inkjet ink, and in a most preferred embodiment the inkjet ink is an UV curable inkjet ink.

A preferred aqueous curable inkjet ink includes an aqueous medium and polymer nanoparticles charged with a polymerizable compound. The polymerizable compound is preferably selected from the group consisting of a monomer, an oligomer, a polymerizable photoinitiator, and a polymerizable co-initiator.

An inkjet ink may be a colourless inkjet ink and be used, for example, as a primer to improve adhesion or as a varnish to obtain the desired gloss. However, preferably the inkjet ink includes at least one colorant, more preferably a colour pigment. The inkjet ink may be a cyan, magenta, yellow, black, red, green, blue, orange or a spot color inkjet ink, preferable a corporate spot color inkjet ink such as red colour inkjet ink of Coca-Cola™ and the blue colour inkjet inks of VISA™ or KLM™. In a preferred embodiment the inkjet ink comprises metallic particles or comprising inorganic particles such as a white inkjet ink.

In a preferred embodiment an inkjet ink contains one or more pigments selected from the group consisting of carbon black, C.I. Pigment Blue 15:3, C.I. Pigment Blue 15:4, C.I Pigment Yellow 150, C.I Pigment Yellow 151, C.I. Pigment Yellow 180, C.I. Pigment Yellow 74, C.I Pigment Red 254, C.I. Pigment Red 176, C.I. Pigment Red 122, and mixed crystals thereof.

Jetting Viscosity and Jetting Temperature

The jetting viscosity is measured by measuring the viscosity of the liquid at the jetting temperature.

The jetting viscosity may be measured with various types of viscometers such as a Brookfield DV-II+ viscometer at jetting temperature and at 12 rotations per minute (RPM) using a CPE 40 spindle which corresponds to a shear rate of 90 s-1 or with the HAAKE Rotovisco 1 Rheometer with sensor C60/1 Ti at a shear rate of 1000 s-1

In a preferred embodiment the jetting viscosity is from 10 mPa·s to 200 mPa·s more preferably from 25 mPa·s to 100 mPa·s and most preferably from 30 mPa·s to 70 mPa·s.

The jetting temperature may be measured with various types of thermometers.

The jetting temperature of jetted liquid is measured at the exit of a nozzle in the printhead (75) while jetting or it may be measured by measuring the temperature of the liquid in the liquid channels or nozzle while jetting through the nozzle.

In a preferred embodiment the jetting temperature is from 10° C. to 100° C. more preferably from 20° C. to 60° C. and most preferably from 30° C. to 50° C.

REFERENCE SIGNS LIST

TABLE 1

| | |
|---|---|
| 50 | inkjet printing device |
| 55 | pulley |
| 75 | printhead |
| 100 | vacuum belt |
| 106 | top-surface of vacuum belt |
| 108 | bottom-surface of vacuum belt |
| 200 | ink-receiver |
| 300 | dimple |
| 305 | dimple perimeter |
| 310 | portion of dimple indentation |
| 315 | transition surface in a dimple |
| 350 | air-cup |
| 355 | air-cup connector |
| 380 | dimple pattern |
| 400 | vacuum table |
| 450 | vacuum chamber |
| 500 | vacuum-belt-air-channel |
| 505 | set of air-channels |
| 900 | drying system |

The invention claimed is:

1. An inkjet printer comprising:

a vacuum belt including a set of air-channels connecting a top surface and a bottom surface of the vacuum belt to couple a planar inkjet receiver to the vacuum belt by air suction in the set of air-channels; wherein the top surface includes a plurality of dimples spaced apart and separate from the set of air-channels;

each of the plurality of dimples includes a closed bottom end; and each of the plurality of dimples is connected with an air-channel of the set of air-channels by an air-cup connector to define an air cup that couples the planar inkjet receiver to the vacuum belt at the respective dimple by air suction.

2. The inkjet printer according to claim 1, wherein the planar inkjet receiver is a sheet or a roll and is selected from the group of a textile, leather, corrugated fibre board, plastic foil, thermosetting resin impregnated paper substrate, folding carton, acrylic plate, honeycomb board, corrugated board, foam, medium density fibreboard, solid board, rigid paper board, fluted core board, plastics, aluminium composite material, foam board, corrugated plastic, carpet, textile, thin aluminium, paper, rubber, adhesive, vinyl, veneer, varnish blanket, wood, flexographic plate, metal based plate, fibreglass, plastic foil, transparency foil, adhesive PVC sheet, and impregnated paper.

3. The inkjet printer according to claim 2, wherein a shape of each of the plurality of dimples is defined by:

an area within a dimple perimeter at the top surface that is between 1 $mm^2$ and 15 $mm^2$; and/or a volume of the dimple that is between 1 $mm^3$ and 30 $mm^3$; and/or the dimple perimeter at the top surface of the vacuum belt defines a circle, ellipse, oval, triangle, square, rectangle, pentagon, hexagon, heptagon, octagon, rhombus, rectangle, regular polygon, or any polygon including at least three sides; and/or a portion of a dimple indentation is spherical or substantially spherical, or polyhedron or substantially polyhedron; and/or a portion of the dimple indentation is defined by a curved enclosure which is circular, elliptical, substantially circular, or substantially elliptical.

4. The inkjet printer according to claim 2, wherein the plurality of dimples define a dimple pattern including a lattice pattern.

5. The inkjet printer according to claim 4, wherein the dimple pattern includes dimple columns and/or dimple rows; and an angle between a side edge of the vacuum belt and the dimple columns and/or dimple rows is between 25 and 65 degrees.

6. The inkjet printer according to claim 4, wherein the dimple pattern is defined by:

a distribution of air cups in the dimple pattern that is more than 2 air cups per $dm^2$; and/or a distribution of the air-channels in an air-sucking zone that is between 1 air-channel per $dm^2$ and 10 air-channels per $dm^2$; and/or if the dimple pattern includes a lattice pattern with dimple rows and dimple columns, a density of air cups in a dimple row and/or a dimple column is more than 2 air cups per $dm^2$; and/or a ratio of a total area within dimple perimeters at the top surface to an area of the air-sucking zone is between 10% and 90%; and/or a ratio of the total area within the dimple perimeters at the top surface to a total area within perimeters of the set of air-channels at the top surface is between 0.4% and 300%; and/or a ratio of an area of each air-channel at the top surface to an area within the dimple perimeter at the top surface is between 5% and 90%.

7. The inkjet printer according to claim 2, wherein a surface roughness ($R_a$) of the top surface is between 8 μm and 350 μm.

8. A computer-to-plate system comprising the inkjet printer according to claim 1.

9. A textile inkjet printer comprising the inkjet printer according to claim 1.

10. A leather inkjet printer comprising the inkjet printer according to claim 1, wherein the leather inkjet printer prints on upholstery, clothing, or shoes.

11. A corrugated substrate inkjet printer comprising the inkjet printer according to claim 1.

12. A plastic foil inkjet printer comprising the inkjet printer according to claim 1.

13. A decoration inkjet printer comprising the inkjet printer according to claim 1, wherein the decoration inkjet printer manufactures decorative laminates.

* * * * *